US008717195B2

(12) United States Patent
Wang et al.

(10) Patent No.: US 8,717,195 B2
(45) Date of Patent: May 6, 2014

(54) TRAFFIC SIGNAL CONTROL SYSTEM, DESIGN METHOD AND SPECIAL EQUIPMENT

(75) Inventors: Qian Wang, Beijing (CN); Dahai Wang, Beijing (CN); Nan Ye, Beijing (CN)

(73) Assignee: HWYL-HUBBL Tech. Development Co, Ltd. In Beijing, Beijing (CN)

( * ) Notice: Subject to any disclaimer, the term of this patent is extended or adjusted under 35 U.S.C. 154(b) by 0 days.

(21) Appl. No.: 13/575,893

(22) PCT Filed: Feb. 1, 2011

(86) PCT No.: PCT/CN2011/070879

§ 371 (c)(1),
(2), (4) Date: Aug. 27, 2012

(87) PCT Pub. No.: WO2011/091772

PCT Pub. Date: Aug. 4, 2011

(65) Prior Publication Data

US 2013/0027224 A1 Jan. 31, 2013

(30) Foreign Application Priority Data

Feb. 1, 2010 (CN) ..... 2010 1 0103079

(51) Int. Cl.
*G08G 1/00* (2006.01)

(52) U.S. Cl.
USPC ..... 340/932; 340/918; 340/929

(58) Field of Classification Search
USPC ..... 340/332, 907, 917, 918, 929, 932; 701/117, 118, 119, 436; 713/168
See application file for complete search history.

(56) References Cited

U.S. PATENT DOCUMENTS 6,473,693 B1 * 10/2002 Kusama ..... 701/436
7,620,812 B2 * 11/2009 Sikora et al. ..... 713/168

(Continued)

FOREIGN PATENT DOCUMENTS

CN 1328314 A 12/2001
CN 101042805 A 9/2007

(Continued)

OTHER PUBLICATIONS

PCT/CN2011/070879 International Search Report dated Jun. 2, 2011 (4 p.).

(Continued)

*Primary Examiner* — Van T. Trieu
(74) *Attorney, Agent, or Firm* — Conley Rose, P.C.

(57) ABSTRACT

A traffic signal control method comprises confirming the shortest green light interval; confirming the conflict area of the different traffic flow and the key conflict point position according to the engineering design for road canalization; confirming the longest clear distance si(m) of the traffic tail unit of green light i and the shortest entry distance sj(m) of the traffic head unit of green light j in conflict with green light i; calculating the longest clear time Max{ti} of the traffic tail unit of green light i and the shortest entry time Min{tj} of the traffic head unit of green light j; calculating the shortest green light interval Iij=A+Max{ti}−Min{tj}; confirming the control scheme for the crossing according to the shortest green light interval and sending the control instruction to the traffic signal display device for displaying in real time according to the control scheme. A traffic signal control system and special equipment are also provided.

14 Claims, 9 Drawing Sheets

(56) References Cited

U.S. PATENT DOCUMENTS

| | | | | |
|---|---|---|---|---|
| 8,171,290 | B1 * | 5/2012 | Sikora et al. | 713/168 |
| 8,185,296 | B2 * | 5/2012 | Yokoyama et al. | 701/117 |
| 2002/0018004 | A1 | 2/2002 | Raswant | |
| 2011/0043378 | A1 * | 2/2011 | Bailey et al. | 340/917 |

FOREIGN PATENT DOCUMENTS

| | | | |
|---|---|---|---|
| CN | 101325008 | A | 12/2008 |
| CN | 101339698 | A | 1/2009 |
| CN | 101763735 | A | 6/2010 |
| RU | 2340949 | C1 | 8/2012 |

OTHER PUBLICATIONS

Beijing: China Communications Press, 1995, p. 108 (1 p.).
Wu Bing, Li Ye, Fourth Edition 2009, p. 161, lines 2-6 (1 p.).
Architectural Press, 2006, p. 15, lines 20-21 (1 p.).
English Summary of Beijing: China Communications Press, 1995, p. 108 (1 p.).
English Summary of Wu Bing, Li Ye, Fourth Edition 2009, p. 161, lines 2-6 (1 p.).
English Summary of Architectural Press, 2006, p. 15, lines 20-21 (1 p.).
PCT/CN2011/070879 International Preliminary Report on Patentability dated Apr. 27, 2012 (7 p.).

* cited by examiner

TRAFFIC SIGNAL CONTROL SYSTEM, DESIGN METHOD AND SPECIAL EQUIPMENT

CROSS REFERENCE TO RELATED APPLICATIONS

This application is a 35 U.S.C. §371 national stage application of PCT/CN2011/070879 filed Feb. 1, 2011, which claims the benefit of Chinese Patent Application No. 201010103079.2 filed Feb. 1, 2010, each of which is hereby incorporated herein by reference in its entirety for all purposes.

STATEMENT REGARDING FEDERALLY SPONSORED RESEARCH OR DEVELOPMENT

Not applicable.

FIELD OF THE INVENTION

The present invention generally relates to the field of traffic information engineering and control, and in particular to a control system and design method for a traffic signal on an intersection and a special device.

BACKGROUND OF THE INVENTION

At a grade intersection, a conflict area is a space which traffic units in different flow directions have to pass. A critical point is the most dangerous point in the conflict area. The traffic units enter into the conflict area in turn according to signal sequence. the movement of a traffic tail unit released when ending a green light i from its stop line to pass through the critical point is referred to as a clearing, and the length of the trace of this movement is referred to as a clearing distance $s_i$, the time spend by the movement is a clearing time $t_i$. The movement of a traffic head unit released when starting a green light j from its stop line to the critical point is referred to as an entry, and the length of the trace of this movement is referred to as an entry distance $s_j$, the time spend by the movement is an entry time $t_j$. The road channelization of the intersection can make the traffic units in different flow directions pass along a certain path respectively, so that each of the conflict areas and the critical point positions is relatively fixed.

Motor vehicles which go straight and turn left are referred to a frame vehicle flow for short. A road traffic signal controller is an apparatus which can change the sequences of road traffic signals, adjust timing and control signal operations of traffic signal lights. The road traffic signal controller has therein a parameter setting program for arranging a phase structure and a phase sequence structure of a signal. In order to avoid the traffic confliction, adjoined conflict phase stages are separated by phase intervals which are usually larger than 0; by setting a parameter, for a frame vehicle flow, a time open interval (namely a line segment without endpoints on the time axis), the green lights in which are more than those in a earlier or later time open interval is referred to as a phase stage. Green lights operating in one phase stage are collectively referred to as the same phase structure. A time open interval of a green light signal which is turned off after the end of the phase stage is referred to as a late off stage. A time open interval of a green light signal which is turned on before the start of the phase stage is referred to as an early on stage. A green light which is continuously on during several phase stages is called a cross-stage green light. A phase stage in which a late off stage and an early on stage which overlaps is referred to as an overlapped phase stage. A green light for the non-frame vehicle flow may further have a late on stage or an early off stage. A cycle means that the time needed to alternately show each of all the light colors of the frame vehicle flow signal lights once. If there are more than two phase stages in a cycle, it is referred to as a multi-phase control; and the operation sequence of the phase stages is referred to as a phase sequence structure.

In the case of a phase interval smaller than 0, those concepts can also be unambiguously applied. In order to ensure traffic safety, any phase interval must be greater than or equal to the contained green interval of the frame vehicle flow. The green interval is a security interval to be set between the time when the green light i is turned off and the time when the green light j conflicting with the green light i is turned on. The minimum value of the green interval is referred to as an i-j minimum green interval. The green time must be greater than or equal to the corresponding minimum green time. Three constraints of the traffic signal control system includes the minimum green interval, the minimum green time and the traffic capacity of the intersection.

Since the three constraints can not be determined accurately by all the typical signal control systems, there are disadvantages in the following four technical means. The existing control design methods are completely ineffective in the case of negative cycle loss time.

Firstly, the road channelization is performed with great arbitrariness, since conventionally there is no specific numerical value index to appraise the road channelization. Therefore the road channelization is regarded as an intellectual activity in many countries and isn't granted the patent protection. In order to find the best road channelization technically, this arbitrariness must be changed by establishing logically preferred numerical value indexes and performing engineering and technology screening.

Secondly, the minimum value of the green interval is uniformly set as 4 s or 3 s, in some conventional signal control designs. Thus the minimum green interval is set to be too small, which is neither reasonable nor safe, leading to accident-proneness in the phase interval. Moreover, the traditional phase structure design is task needed to be completed before the timing design. Presently a phase structure scheme is determined mainly by experience judgment or enumeration. No literature can assure that a phase structure scheme therein is the best. In addition, in these classic systems, it is not able to configure a countdown display and it is difficult to reduce the start-up lost time.

FIG. 2 shows an entry flow rate-time curve at the section of a stop line of an intersection. As shown in the curve, due to forbiddance for running the red light, the vehicle flow passing through the stop line doses not reach the saturation flow rate near the time when the yellow light is turned off, and the passage time loss caused by this non-saturation flow rate is referred to as a yellow end loss time. When the green light is turned on, the vehicle flow may be difficult to enter with a saturation flow rate at the beginning, and the passage time loss caused by this non-saturation flow rate is referred to as a green start loss time. The total sum of the green loss time and the yellow end loss time is referred to as a start-up loss time. "According measurements actually carried out in British, the start-up lost time of the motor vehicle flow is 1.48 seconds, and the yellow end loss time is 0.13 seconds" 交通管理与控制 Beijing: China Communications Press, 1995, P108). Obviously, the start-up lost time is independent of the minimum green interval.

An effective green time of the vehicle flow is the time when the vehicle is released by a saturation flow rate during a cycle, namely:

$$G_{ej}=G_j+A-l=C_0\lambda_j \quad (1)$$

The saturation degree $q_j$ of the vehicle flow j is used to describe the congestion level of the frame vehicle flow at the intersection:

$$q_j=C_0Q_j/G_{ej}n_jQ_{sj}=Q_j/\lambda_jn_jQ_{sj}\leq q \quad (2)$$

For the maximum allowable saturation q, each split $\lambda_j$ should be greater than or equal to each corresponding required split $\underline{\lambda_j}$:

$$\underline{\lambda_j}=Q_j/qn_jQ_{sj} \quad (3)$$

In the above equation, $G_{ej}$ is the effective green time of the frame traffic flow; $G_j$ is the green time of the traffic flow; A is the yellow light time; l is the start-up loss time; $C_0$ is the cycle; $\lambda_j$ is the split, namely the ratio of the effective green time to the cycle: $\lambda_j=G_{ei}/C_0$; $n_j$ is the number of traffic lanes; q is the maximum allowable saturation degree; $Q_{sj}$ is the saturation flow rate j of the frame vehicle flow in a single traffic lane and is measured in pcu/h; $Q_j$ is the actual flow rate of the frame vehicle flow j and is measured in pcu/h; and $\underline{\lambda_j}$ is the required split of the frame vehicle flow.

In determining the cycle and the green light timing, the frame vehicle flow which determines the green time in each phase stage is referred to as a key vehicle flow. The key vehicle flow has a bigger saturation degree except in the case where the green time is equal to the minimum green time. A periodical path which is formed of the key vehicle flow green time interval and the prior or posterior green time intervals connected sequentially is referred to as a key path.

For all the frame vehicle flow which can form a periodical path, the cycle is expressed by the following relational expression where the $I_i$ denotes the green interval:

$$C_0=\Sigma(G_i+I_i) \quad (4)$$

A cycle loss time L is the difference between the total sum of the effective green time in the key path and the cycle:

$$L=C_0-\Sigma G_{ei} \quad (5)$$

In any conventional timing design method, the cycle loss time is an important parameter that must be accurately determined. However, an estimation value which is very inaccurate is commonly used instead. The cycle loss time follows by substituting (4) into (5):

$$L=\Sigma I_i-(A-l)\times n \quad (6)$$

SUMMARY OF THE INVENTION

The present invention provides a traffic signal control method, including determining a control scheme by determining a minimum green interval. The method includes the following steps.

1) Determining a conflict area and a critical point position for different traffic flows according to an engineering design for a road channelization.

2) Determining a maximum clearing distance $s_i$(m) of a green light i and a minimum entry distance $s_j$(m) of a green light j in conflict with the green light i.

3) Calculating a maximum clearing time $\mathrm{Max}\{t_i\}$ of the traffic tail unit released by the green light i and a minimum entry time $\mathrm{Min}\{t_j\}$ of the traffic head unit released by the green light j.

4) Calculating the minimum green interval $$I_{ij}=A+\mathrm{Max}\{t_i\}-\mathrm{Min}\{t_j\} \quad (7).$$

wherein in the equation, $I_{ij}$ is the minimum green interval to be set from the turnoff of the green light to the turn-on of the green light j in conflict with the green light i; A is a yellow time; $t_i$ is the clearing time of the signal i; and tj is the entry time of the signal j;

5) Determining the control scheme for an intersection according to the minimum green interval and sending a control instruction to a traffic signal display apparatus for displaying in real time according to the control scheme.

The equation (7) is quite different from the equation in 交通管理与控制 (Wu Bing, Li Ye, Fourth Edition 2009, P. 161), where a vehicle braking time is shorter than the yellow time A in the equation (7). The equation (7) is also significantly different from the equation in 交通信号控制指南 (Architectural Press, 2006, P. 15), where a passing time is also shorter than the yellow time A in the equation (7). In the equation (7), "the maximum clearing time of the signal i and the minimum entry time of the signal j" further enhance the safety and security. Therefore, the minimum green interval in the equation (7) is longer and safer, and the technical problem of unsafe traffic is solved.

The selections of the maximum clearing time and the minimum entry time are all carried out within the conventional and legal behaviors of the traffic flow other than the rare and illegal behaviors. However, the traffic is complex. Although being well-considered, there may still be occasional accidents. The driver of the first vehicle in the traffic flow still needs to drive carefully along the channelization path in compliance with law and to always get ready to respond and yield to any other traffic flows which are released earlier and haven't be cleared, otherwise the driver should be fully responsible for an accident. "The clearing time and the minimum entry time" are only for the traffic flow. "Stopping the vehicle and yielding to a pedestrian when the pedestrian is passing a crosswalk" is the obligation of the vehicle, rather than the obligation of design of the signal control scheme.

The important effect of (7) also lies in the extension as follows. Assuming that the total sum of the differences between the green interval and the minimum green interval of each traffic flow in the key path is denoted by X, the minimum green interval in equation (7) may be substituted into the equation (6) and thus the following expression is obtained:

$$L=\Sigma(\mathrm{Max}\{t_i\}-\mathrm{Min}\{t_j\})+1\times n+X \quad (8).$$

The equation (8) shows that the cycle loss time L is an inherent property of the signal control system, which is unrelated to the yellow time which may be set artificially and to the actual flow rate requirement. The above mentioned eight equations are completely self-consistent and compatible with each other, which fully prove that it is rational to use the yellow time rather than "passing time" or the "vehicle braking time".

The equation (8) further shows that there are the following four complementary technical means to mine time resources for an intersection and reduce the cycle loss time: 1. finding a key path to minimize a sum of the interval loss time between the earlier key traffic flow and the later key traffic flow; 2. selecting a preferable channelization scheme so as to reduce the minimum green interval in the key path; 3. reducing the start-up loss time l of the traffic flow by any possible technical means; 4. reducing the total sum X of the differences between the green interval and the minimum green interval of each traffic flow as small as possible until the total sum reaches 0.

In fact, although each of the four technical means has limited effectiveness, the cycle loss time may become negative when the four technical means are effected together. There are the following advantages if a signal control system has a negative cycle loss time. The total sum of the effective green time of the traffic flow in the key path is larger than the cycle and there is additional effective releasing time. The shorter the cycle loss time, the longer the additional effective releasing time. By minimizing the ratio of the cycle loss time to the cycle in the case of the rationally allowed maximum saturation degree, the absolute value of the negative cycle loss time can reach the maximum, the system cycle can reach the minimum, the proportion of the additional effective releasing time can reach the maximum, the traffic capacity and efficiency of the intersection can reach the maximum and the delay time due to stop of the vehicle can reach the minimum.

The present invention which is based on the traffic signal control method will provide a technical scheme including the four technical means which may finally realize a negative cycle loss time, so as to solve the technical problem of designing a control scheme in the case where the cycle loss time is negative.

DETAILED DESCRIPTION OF THE INVENTION

Figure 3:
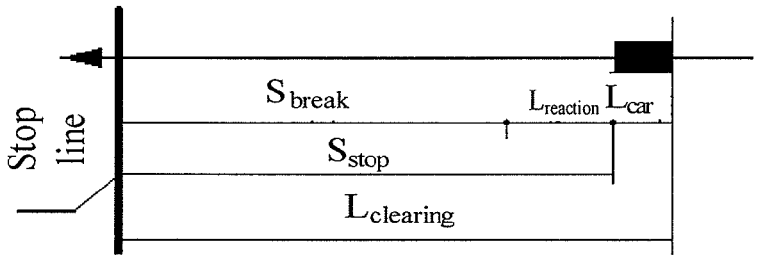
FIG. 3 illustrates relevant factors for determining a minimum yellow light time A, in which $L_{reaction}$ is a maximum distance which a vehicle can pass in the maximum perception reaction time, and $S_{brake}$ is a maximum braking distance needed from the beginning of the breaking to a stop.

The present invention provides a traffic signal control method, including determining a control scheme by determining a minimum green interval. In a first embodiment, the information for a road channelization of an intersection may include various information in the engineering design diagram of the road channelization of the intersection. FIG. 3 illustrates relevant factors for determining a minimum yellow time A.

Figure 1:
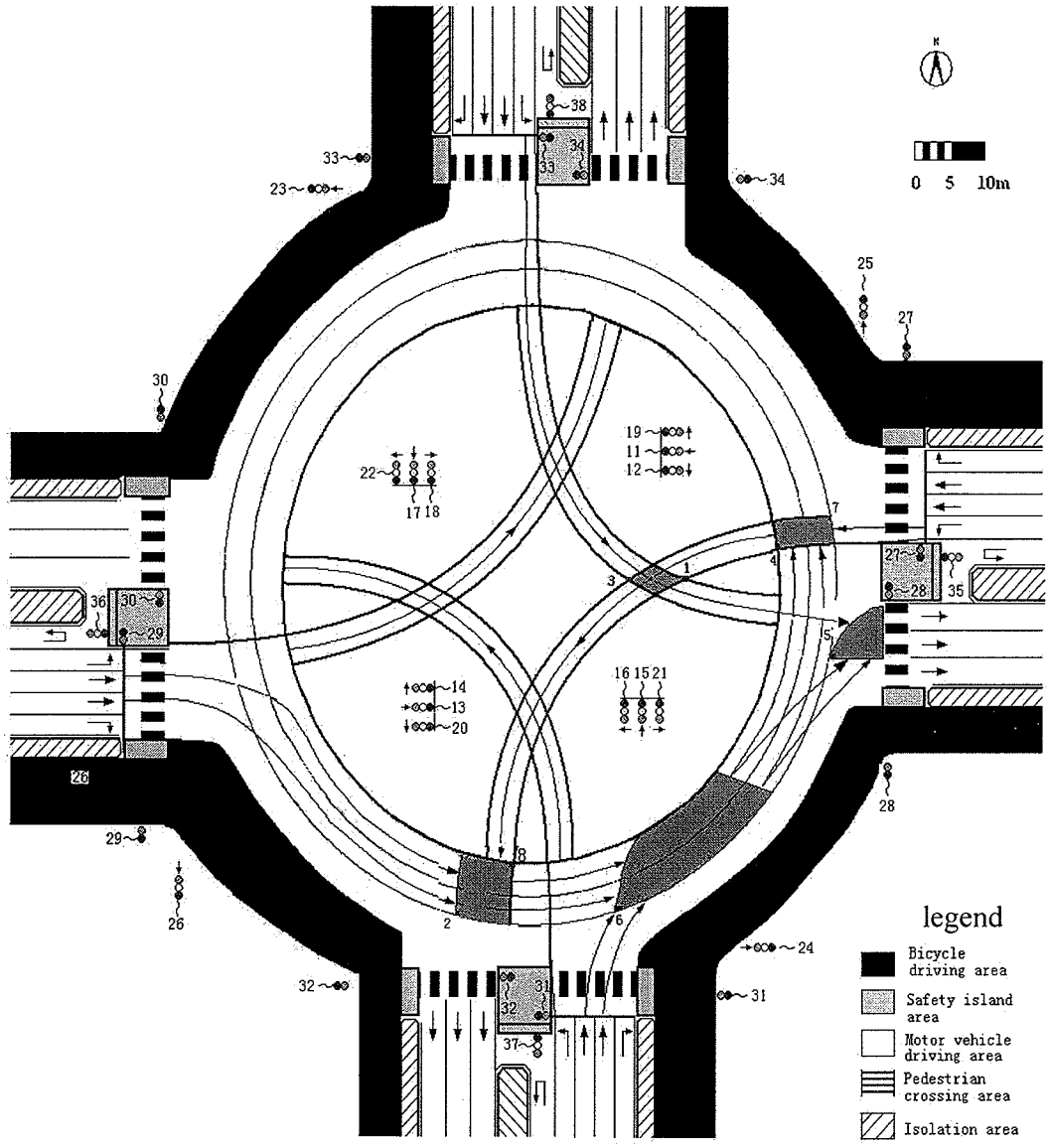
FIG. 1 is a diagram illustrating a Wang channelization scheme and a position of a conflict point in a conflict area, in which 1 to 10 indicate conflict areas between every two frame vehicle flows (the other similar thirty marks are omitted for the purpose of clear diagram), 11 to 18 indicate signal lights of the frame vehicle flows, 20 to 22 indicate right-turn signal lights, 23 to 26 indicate non-motor vehicle signal lights, 27 to 34 indicate pedestrians signal lights and 35 to 38 are U-turn vehicle signal lights.
Figure 2:
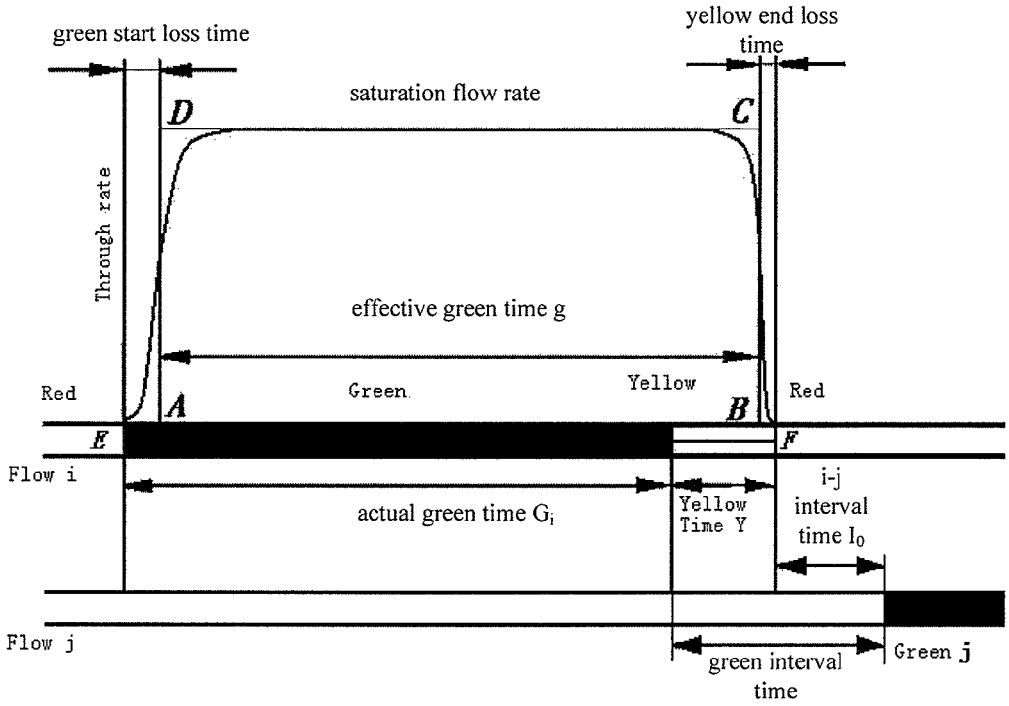
FIG. 2 is an illustrative diagram of entry flow rate-time curve at a stop line section of an intersection.

The information for road channelization shown in FIG. 1 is used. The number of each traffic lane is expressed as follows: east straight $N_1$=2, west left $N_2$=1, north straight $N_3$=2, south left $N_4$=1, west straight $N_5$=2, east left $N_6$=1, south straight $N_7$=2 and north left $N_8$=1. Position of each of critical point positions 1 to 10 is determined in the channelization scheme of FIG. 1 and a maximum clearing distance $s_i$(m) and a minimum entry distance $s_j$(m) are measured respectively, as shown in Tables 1 and 2.

TABLE 1 the maximum clearing distance $s_i$ and the minimum entry distance $s_j$ of each frame vehicle flow at the intersection in FIG. 1

| straight | | | | | turn left | | | | |
|---|---|---|---|---|---|---|---|---|---|
| conflict point | east | west | south | north | conflict point | east | west | south | north |
| inlet pedestrian entry | 2 | 2 | 2 | 2 | inlet pedestrian entry | 2 | 2 | 2 | 2 |
| inlet non entry | 10 | 10 | 10 | 10 | inlet non entry | 10 | 10 | 10 | 10 |
| inlet pedestrian clearing | 30 | 30 | 30 | 30 | inlet pedestrian clearing | 30 | 30 | 30 | 30 |
| inlet non clearing | 38 | 38 | 38 | 38 | inlet non clearing | 38 | 38 | 38 | 38 |
| 6 near straight entry | 24 | 24 | 24 | 24 | 7 entry | 18 | 18 | 18 | 18 |

TABLE 1-continued the maximum clearing distance $s_i$ and the minimum entry distance $s_j$ of each frame vehicle flow at the intersection in FIG. 1

| straight | | | | | turn left | | | | |
|---|---|---|---|---|---|---|---|---|---|
| conflict point | east | west | south | north | conflict point | east | west | south | north |
| 6 far straight clearing | 30 | 30 | 30 | 30 | 4 clearing | 43 | 43 | 43 | 43 |
| 2 entry | 74 | 68 | 74 | 80 | near 1 entry | 39 | 39 | 39 | 39 |
| 8 clearing | 92 | 87 | 92 | 98 | near 3 entry | 84 | 86 | 76 | 82 |
| 4 entry | 83 | 78 | 83 | 89 | far 3 clearing | 55 | 55 | 55 | 55 |
| 6 far straight clearing | 107 | 102 | 107 | 113 | far 1 clearing | 95 | 97 | 87 | 93 |
| 7 clearing | 110 | 105 | 110 | 116 | 8 entry | 98 | 100 | 90 | 96 |
| 6 near straight clearing | 113 | 108 | 113 | 119 | 5 left entry | 126 | 128 | 118 | 124 |
| 5 straight entry | 154 | 150 | 154 | 159 | 2 clearing | 126 | 128 | 118 | 124 |
| 5 left clearing | 160 | 156 | 160 | 165 | 5 straight clearing | 130 | 134 | 124 | 130 |
| outlet non entry | 148 | 144 | 148 | 153 | outlet non entry | 110 | 112 | 102 | 108 |
| outlet pedestrian entry | 166 | 162 | 166 | 171 | outlet pedestrian entry | 114 | 116 | 106 | 112 |
| outlet non clearing | 162 | 158 | 162 | 167 | outlet non clearing | 120 | 122 | 112 | 118 |
| outlet pedestrian clearing | 170 | 166 | 170 | 176 | outlet pedestrian clearing | 128 | 130 | 120 | 126 |

TABLE 2 the maximum clearing distances and the minimum entry distances of the right-turn vehicle, pedestrian and non-motor vehicle at the intersection in FIG. 1 (newly)

| conflict point | east right | west right | south right | north right | conflict point | two-way pedestrian | not-motor vehicle |
|---|---|---|---|---|---|---|---|
| inlet pedestrian entry | 2 | 2 | 2 | 2 | outlet entry | 0.25 | 1.25 |
| inlet non entrance | 10 | 10 | 10 | 10 | outlet exit | 10.75 | 13.75 |
| inlet pedestrian clearing | 30 | 30 | 30 | 30 | inlet left entry | 0.20 | 19.70 |
| inlet non clearing | 38 | 38 | 38 | 38 | inlet straight entry | 3.10 | 22.60 |
| outlet non entry | 71 | 71 | 72 | 84 | inlet right entry | 0.20 | 28.40 |
| outlet pedestrian entry | 79 | 79 | 80 | 92 | inlet left exit | 11.80 | 24.60 |
| outlet non clearing | 85 | 85 | 86 | 98 | inlet straight exit | 8.90 | 30.40 |
| outlet pedestrian clearing | 91 | 91 | 92 | 104 | inlet right exit | 11.80 | 33.30 |

In Tables 1 and 2, the "entry" indicates the minimum entry distance; the "clearing" indicates the maximum clearing distance, the length of the vehicle is 6 m and the width of the road is 2 m; the "non" indicates the conflict point of the non-motor vehicle, the "pedestrian" indicates the conflict point of the pedestrian, the conflict points 5 and 6 are respectively the conflict points due to overlapped interflow of 5 straight, 5 left, 6 near straight and 6 far straight. These points can show 16 kinds of cross conflictions and 4 kinds of interflow conflictions in 2 different time sequences in the frame vehicle flows of FIG. 1.

Further, in Table 2, the "outlet" indicates the conflict point of the outlet area for the motor vehicle, the "inlet" indicates the conflict point of the inlet area for the motor vehicle. In Table 3, the "left", "straight", "right" indicate respectively the conflict points of the left motor vehicle, the straight motor vehicle the right motor vehicle.

The method for determining the minimum green interval $I_{ij}$ during the rush hours may include the following step or steps: determining speed condition parameters at the rush hours within a conventional and legal scope, in which the speed condition parameters include the minimum average clearing speed $v_i$(m/s) of a clearing tail vehicle i, the maximum average acceleration $a_j$(m$^2$/s) of an entry head vehicle and the upper limit $v_j$(m/s) of the entry speed.

In the present embodiment, assuming that the highest speed limits of frame vehicle flows in each of the entry paths are all 60 km/h, the speed condition parameters including the speed of a non-motor vehicle $v_j$=−4 m/s/h, the pedestrian speed $v_i$=1.5 m/s and the yellow time=4 s are calculated with the following calculation speed condition parameters: the clearing speed of a motor vehicle $v_i$=12 m/s, the average acceleration of an entry vehicle $a_j$=4 m/s$^2$ and the maximum speed of an entry vehicle $v_j$=10 m/s; calculating the maximum clearing time $\mathrm{Max}\{t_i\}=s_i/v_i$(s) in second by rounding to 2 decimal places; calculating the minimum entry time in second by rounding to 2 decimal places:

i. the time when the entry head vehicle reaches the upper limit of the speed is $t_{0j}=v_j/a_j$(s);

ii. the distance passed by the entry head vehicle when the entry head vehicle reaches the upper limit of the speed is $s_{0j}=a_j t_{0j}^2/2$ (m);

iii. if the entry distance $s_j<s_{0j}$, the minimum entry time is $Min\{t_j\}=[s_j/2]^{1/2}$ (s); and iv. if the entry distance $s_j \geq s_{0j}$, the minimum entry time is $Min\{t_j\}=t_{0j}+(s_j-s_{0j})/v_j$ (s);

calculating the minimum green interval $I_{ij}=A+Max\{t_i\}-Min\{t_j\}$ from the clearing tail vehicle i to the entry head vehicle j.

The minimum green interval matrix table 3 may be obtained by arranging each of the clearing traffic flows in sequence in the longitudinal direction, arranging each of the entry traffic flows in sequence in the horizontal direction and filling the table with each of the minimum green interval correspondingly.

TABLE 3 the minimum green interval matrix (s) of the intersection in FIG. 1 under the calculated speed condition parameters

| | entry Vehicle | | | | | | | | | | | | | |
|---|---|---|---|---|---|---|---|---|---|---|---|---|---|---|
| Clearing vehicle | 1 east straight | 2 West straight | 3 East left | 4 West left | 5 South straight | 6 North straight | 7 South left | 8 North left | 9 East right | 10 West right | 11 South right | 12 North right | 13 east non-motor | 14 West non-motor |
| 1 east straight | | | | 1 | −5 | 11 | 5 | 11 | | | | | | |
| 2 West straight | | | 1 | | 9 | −6 | 10 | 4 | | | | | | |
| 3 East left | | 7 | | | −1 | −2 | 7 | 0 | | | | | | 14 |
| 4 West left | 7 | | | | −1 | −2 | 0 | 7 | | | | | 14 | |
| 5 South straight | 10 | −4 | 11 | 4 | | | | 1 | | | | | 18 | 2 |
| 6 North straight | −5 | 11 | 4 | 11 | | | 3 | | | | | | 2 | 18 |
| 7 South left | −2 | −1 | −1 | 7 | | 5 | | | | | | | | 3 |
| 8 North left | −1 | −1 | 7 | −1 | 6 | | | | | | | | 3 | |
| 9 East right | | | | | | | | | | | | | 11 | |
| 10 West right | | | | | | | | | | | | | | 11 |
| 11 South right | | | | | | | | | | | | | | 1 |
| 12 North right | | | | | | | | | | | | | 1 | |
| 13 east non-motor | | | | −5 | −8 | 10 | | 8 | 0 | | | 11 | | |
| 14 West non-motor | | | −4 | | 10 | −9 | 8 | | | 0 | 11 | | | |
| 15 South non-motor | 10 | −8 | 8 | | | | | −4 | 11 | | −1 | | | |
| 16 north non-motor | −8 | 10 | | 8 | | | −4 | | | 11 | | −2 | | |
| 17 East inlet pedestrian | 5 | | 7 | | | | | | 7 | | | | | |

TABLE 3-continued

| the minimum green interval matrix (s) of the intersection in FIG. 1 under the calculated speed condition parameters | | | | | | | | | | |
|---|---|---|---|---|---|---|---|---|---|---|
| 18 East outlet pedestrian | | −10 | | | | | −5 | | −2 | |
| 19 West inlet pedestrian | | 5 | | 7 | | | | 7 | | |
| 20 West outlet pedestrian | −11 | | | | | −4 | | | | −3 |
| 21 South inlet pedestrian | | | | | 5 | 7 | | | 7 | |
| 22 South outlet pedestrian | | | −5 | | | | −11 | | | |
| 23 North inlet pedestrian | | | | | | | 5 | 7 | | 7 |
| 24 North Outlet pedestrian | | | | −5 | −10 | | | | −1 | |

| | entry Vehicle | | | | | | | | | |
|---|---|---|---|---|---|---|---|---|---|---|
| Clearing vehicle | 15 South non-motor | 16 north non-motor | 17 East inlet pedestrian | 18 East outlet pedestrian | 19 West inlet pedestrian | 20 West outlet pedestrian | 21 South inlet pedestrian | 22 South outlet pedestrian | 23 North inlet pedestrian | 24 North outlet pedestrian |
| 1 east straight | 2 | 18 | 4 | | | 18 | | | | |
| 2 West straight | 17 | 2 | | 18 | 4 | | | | | |
| 3 East left | 3 | | 7 | | | | | 15 | | |
| 4 West left | | 3 | | | 7 | | | | | 15 |
| 5 South straight | | | | | | | 4 | | | 18 |
| 6 North straight | | | | | | | | 19 | 4 | |
| 7 South left | | 13 | | | | 14 | 7 | | | |
| 8 North left | 14 | | | 15 | | | | | 7 | |
| 9 East right | 1 | | 7 | | | | | | | 12 |
| 10 West right | | 1 | | | 7 | | | 12 | | |
| 11 South right | 11 | | | 12 | | | | | 7 | |
| 12 North right | | 12 | | | | 13 | 7 | | | |
| 13 east non-motor | | | | | | | | | | |

TABLE 3-continued

| the minimum green interval matrix (s) of the intersection in FIG. 1 under the calculated speed condition parameters |
|---|
| 14 West non-motor |
| 15 South non-motor |
| 16 north non-motor |
| 17 East inlet pedestrian |
| 18 East outlet pedestrian |
| 19 West inlet pedestrian |
| 20 West outlet pedestrian |
| 21 South inlet pedestrian |
| 22 South outlet pedestrian |
| 23 North inlet pedestrian |
| 24 North Outlet pedestrian |

In order to simplify the calculation, the minimum green interval of the frame vehicle flow during the off-peak hours may be 1-2 seconds longer than that during the rush hours correspondingly. Chain family complete classification and methods for determining a Wang chain family and a sub-Wang chain family. There are 40 minimum green intervals among the frame vehicle flows, however there are only 4 minimum green intervals in the equation (6). The choices all lies with the key paths.

In the present application, all of the cycle paths which might be the key paths are referred to as traffic flow chains. The different between traffic flow chain and the key path is that the traffic flow chain is also related to other frame vehicle flows which are released in the same stage of the frame vehicle flow, namely a phase structure at a basic phase stage.

At an intersection, only two kinds of the frame vehicle flow can be allowed to pass without confliction during each phase stage. There are at least four kinds of different non-confliction phase stages in a cycle in which the eight kinds of the frame vehicle flows can get the non-confliction pass phase stages respectively. This combined phase stage in the non-confliction phase structure is referred to as a basic phase stage; the combined phase stage in other phase structures formed by early-on or late-off or overlapping green light in some frame vehicle flows is referred to as a derivative phase stage. The traffic flow chains with the same basic phase structure and phase stage sequence belong to the same chain family.

In the case where the total sum of the green time of a certain frame vehicle flow and the prior and posterior minimum green interval is shorter than a cross stage minimum green interval between the prior frame vehicle flow and the posterior frame vehicle flow, the traffic flow chains thus formed by connection of a inter-stage directed arc is referred to as a cross stage traffic flow chain.

Figure 6:
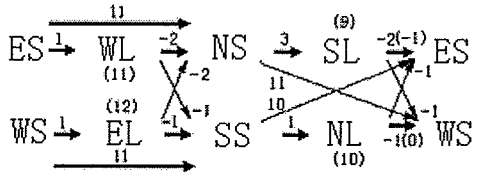
FIG. 6 illustrates a Wang chain family diagram in the case of a cross-stage vehicle flow chain and a Wang minimum green time for a left-turn vehicle.

The chain family diagram consists of the chain families: each green interval constraint is indicated by a directed arrow with a number, which is referred to as an Arc. The green time of each of the frame vehicle flows is referred to as a Node. Thus each of the chain family diagrams may form a network topology diagram, as shown by the chain family legend in FIG. 6. In the chain family diagram, there are the limited traffic flow chains from the start node to the end node. The chain family diagram only focus on the order and does not care about which traffic flow starts.

According to the present application, there is no need to consider the cross stage traffic flow chain based on the Wang minimum green time explained in the following three sections. The chain family diagram without a cross stage traffic flow chain and a traffic flow confliction has a two-row structure, each end to end to form a cycle. The calculation equation (6) which is independent of the flow rate may be extended for calculating the cycle loss time of a general traffic flow chain. The traffic flow chain and the chain family diagram are studied so as to help to find a key traffic flow chain.

For a determined chain family diagram, each of the traffic flow chains may become the key traffic flow chain, as long as the traffic requirement of the traffic flow related with the traffic flow chain is big enough to be a key traffic flow chain which can determine the timing for the green time in its phase stage; the cycle loss time of each of the traffic flow chains may become an actual cycle loss time and should be concerned. The cycle loss time for different traffic flow chains is different, and the differences are huge and cannot be ignored. The present invention is more concerned about scheme adjustment for the chain family and the average value of the cycle loss time in the chain family.

The cycle loss time of each of the traffic flow chains (except the cross stage traffic flow chains) in the chain family is added and then divided by the number of the traffic flow chains in the chain families, so as to obtain the average value of the cycle loss time of the traffic flow chains:

$$\underline{L}=\Sigma(\Sigma I_i)/m-(A-l)\times n \tag{9}$$

where $\underline{L}$ is the average value of the cycle loss time; $I_i$ is the green interval of each of the traffic flow chains; m is the number of the traffic flow chains in the chain family; A is the yellow time; l is the start-up loss time; and n is the number of the green intervals in the traffic flow chain.

In the case of an unsaturated conventional traffic, any chain family diagram may has its key traffic flow chain, as long as the traffic requirement of the traffic flow related with the traffic flow chain is big enough to be a key traffic flow chain which can determine the timing for the green time in its phase stage. Therefore, there may be 22 kinds of different key traffic flow chains for 22 chain family diagrams. Before the traffic requirement is determined, although a specific key traffic flow chain may not be selected artificially, the key traffic flow chain may be defined by selecting a chain family, so as to define the possible range of the cycle loss time. Thus it is particularly important to select the best chain family from the traffic flow chain complete classification i.e., the chain family.

The sum of all of the green times and the green intervals of the traffic flow chain is referred as a chain length. The minimum chain length of a traffic flow chain is different from the cycle path equation (4) in that the minimum chain length of a traffic flow chain refers to the sum of each green time and each minimum green interval of the traffic flow chain:

$$C_L=\Sigma(G+I)$$

where $C_L$ is the minimum chain length of a traffic flow chain; G is the green times of each of traffic flows; and I is the minimum green interval.

In a second embodiment a chain family complete classification and a chain family with the minimum average value of the cycle loss time, is in a Wang chain family. The intersection shown in FIG. 1 has totally 114 traffic flow chains which may be completely divided into 9 chain families with the traffic flow confliction and 13 chain families without the traffic flow confliction. The chain families are listed, and the cycle loss times of the traffic flow chains are calculated according to Table 3 and the results are listed in Table 4.

TABLE 4 the cycle loss times of each of chain families and the average value of the cycle loss time of the chain families according to the Wang channelization scheme

| serial number | average value | basic phase stage and the minimum green interval (second) (yellow time 4 s) | | | | cycle loss time (including each start-up loss time l = 1.5 (seconds)) |
|---|---|---|---|---|---|---|
| | | phase stage 1 | phase stage 2 | phase stage 3 | phase stage 4 | |
| 1 | 17 | east and west released 11 | south and north released 11 | | | 17 |
| 2 | 12.5 | east and west released 11 | south straight 1 north straight 3 | north turn left 7 south turn left 7 | | 11.5, 13.5 |
| 3 | 20.0 | east and west released 11 | south turn left 5 north turn left 6 | north straight 11 south straight 11 | | 19.5, 20.5 |
| 4 | 15.5 | east and west released 11 | south straight 1 south turn left 5 | north turn left 7 north straight 11 | | 11.5, 19.5 |
| 5 | 17.0 | east and west released 11 | north turn left 6 north straight 3 | south straight 11 south turn left 7 | | 20.5, 13.5 |
| 6 | 21.0 | west turn left 7 east turn left 7 | east straight 11 west straight 10 | south and north released 11 | | 21.5, 20.5 |
| 7 | 11.5 | east straight 1 west straight 1 | west turn left 7 east turn left 7 | south and north released 11 | | 11.5, 11.5 |
| 8 | 16.0 | east turn left 7 east straight 1 | west straight 10 west turn left 7 | south and north released 11 | | 20.5, 11.5 |
| 9 | 16.5 | west straight 1 west turn left 7 | east turn left 7 east straight 11 | south and north released 11 | | 11.5, 21.5 |
| 10 | 17 | east and west straight 11 | south and north straight 11 | | | 17 |
| 11 | 17.5 | east straight 5, 11 west straight 10, 4 | south turn left 5 north turn left 6 | north straight 11, 4 south straight 4, 11 | west turn left 7 east turn left 7 | 18, 18, 16, 18 |

TABLE 4-continued

| the cycle loss times of each of chain families and the average value of the cycle loss time of the chain families according to the Wang channelization scheme | | | | | | |
|---|---|---|---|---|---|---|
| serial number | average value | basic phase stage and the minimum green interval (second) (yellow time 4 s) | | | | cycle loss time (including each start-up loss time l = 1.5 (seconds)) |
| | | phase stage 1 | phase stage 2 | phase stage 3 | phase stage 4 | |
| 12 | −9.75 | east straight 1<br>west straight 1 | west turn left −2, −1<br>east turn left −2, −1 | north straight 3<br>north straight 1 | south turn left −2, −1<br>north turn left −1, −1 | −10, −10, −9, −10 |
| 13 | 3.0 | east straight 1<br>west straight 1 | west turn left0, 7<br>east turn left 7, 0 | south turn left 5<br>north turn left 6 | north straight −5, 11<br>south straight 10, −4 | −9, 14, 14, −7 |
| 14 | 3.25 | east straight 11, −5<br>west straight −6, 9 | north straight 3<br>South straight 1 | south turn left 7, −1<br>north turn left −1, 7 | west turn left 7<br>east turn left 7 | 18, −8, −7, 14 |
| 15 | 2.0 | east straight 5, 11<br>west straight 10, 4 | south turn left 7, −1<br>north turn left −1, 7 | west turn left −2, −1<br>east turn left −2, −1 | north straight −5, 11<br>south straight 10, −4 | −5, 11, −13, 3, −7, 9, 1, 17, 16, 2, 8, −6, 0, −12, 10, −4 |
| 16 | 2.0 | east straight 11, −5<br>west straight −6, 9 | north straight 11, 4<br>south straight 4, 11 | west turn left 0, 7<br>east turn left 7, 0 | south turn left −2, −1<br>north turn left −1, −1 | 10, 18, 10, 4, −13, −5, 1, −5, −6, 1, −6, −13, 2, 9, 16, 9 |
| 17 | 2.75 | east straight 1<br>east turn left 7 | west turn left 0, −1<br>west straight 10, 9 | south turn left 5<br>south straight 1 | north straight −5, 4<br>north turn left −1, 7 | −9, −10, 16, 14 |
| 18 | 3.75 | east straight 1<br>east turn left 7 | west turn left −2, 7<br>west straight −6, 4 | north straight 3<br>north turn left 6 | south turn left −2, −1<br>south straight 10, 11 | −10, 14, −7, 18 |
| 19 | −4.375 | east straight 5, −5<br>east turn left 7, −1 | south turn left 7, −1<br>south straight 4, −4 | west turn left −2, 7<br>west straight −6, 4 | north straight −5, 4<br>north turn left −1, 7 | −5, 8, −17, −3, −18, 3, −30, −16, 6, 18, −6, 7, −5, 7, −17, −4 |
| 20 | 0.875 | east straight 5, −5<br>east turn left 7, −1 | south turn left 5<br>south straight 1 | north straight 11, 11<br>north turn left −1, −1 | west turn left 7<br>west straight 1 | 18, −8, 14, −10 |
| 21 | 1.25 | east straight 11, 11<br>east turn left −2, 0 | north straight 3<br>north turn left 6 | south turn left 7, −1<br>south straight 4, −4 | west turn left 7<br>west straight 1 | 18, 18, −9, −7 |
| 22 | 9.25 | east straight 11, 11<br>east turn left −2, 0 | north straight 11, 11<br>north turn left −1, −1 | west turn left 0, −1<br>west straight 10, 9 | south turn left −2, −1<br>south straight 10, 11 | 10, 22, 20, 32, −2, 10, 9, 20, −3, 9, 8, 19 −12, −1, −2, 9 |

In Table 4, if there is only one number behind frame vehicle flow, the number indicates the minimum green interval in the case that the frame vehicle flow is an ending green light. If there are two numbers behind each frame vehicle flow, the numbers indicates respectively 2 minimum green intervals in the case that the frame vehicle flow is the ending green light and the later two frame vehicle flows being starting green lights, where the former number corresponds to the above frame vehicle flow and the later number corresponds to the following frame vehicle flow. In the case that there is not only one frame vehicle flow for the ending green light or there is not only one frame vehicle flow for the starting green light (such as the mixed vehicle flow in the first 9 sequence structures), the minimum green interval between the conflict green lights for all of the possible i and j is $I=\mathrm{Max}\{I_{ij}\}$. Here the calculation speed condition parameters are all selected for various signal control schemes without traffic flow confliction. As space is limited, the calculation speed condition parameters are not reselected for the mixed releasing schemes with traffic flow confliction. Theoretically the speed of the vehicle in the later schemes is slower and thus the minimum green interval between the conflict green lights may be larger than the values in Table 07-1. Therefore, it is not recommended here and is listed only for qualitative comparison.

In Table 4, all of the chain families are listed, and the numbers attached to the lower right corner of the serial numbers in the first column are the average values of the cycle loss time. The chain family with the minimum average value L of the cycle loss time is defined as Wang chain family, and the chain family with the sub-minimum average value L of the cycle loss time is defined as sub-Wang chain family.

The chain family diagram whose green time $\{G_i\}$ and green interval $\{I_i\}$ are determined is referred as a chain family scheme. The infinite chain family schemes are completely classified into the finite chain families, so as to facilitate the study of the commonalities and natures of the chain family scheme, such as the basic phase structure and the sequence structure.

In Table 4, all of the traffic flow chains are completed divided into 22 chain families. Actually, all of the infinite chain family schemes are completed divided according to the basic phase structures and the phase sequence structures. A conventional method may also enumerate so many phase structures and phase sequence structures, however there has not yet been any literature that can reasonably say that "certain phase structure and phase sequence structure are the best to achieve high efficiency", since there is no effective performance index and method for comparing and screening.

Figure 4:
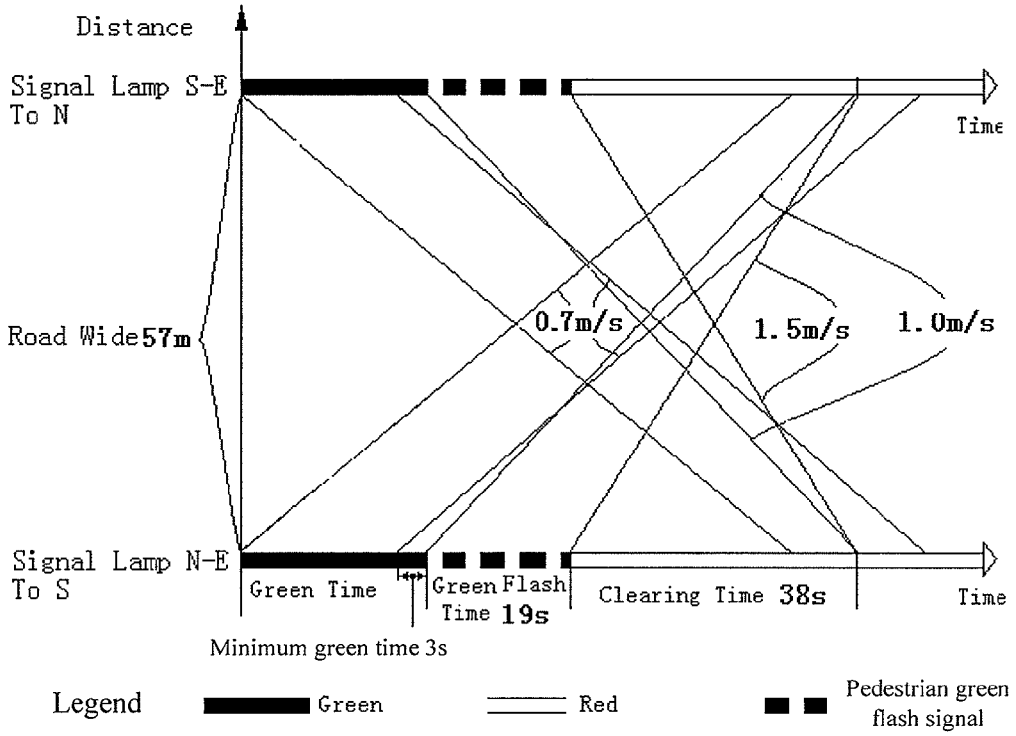
FIG. 4 is an illustrative diagram illustrating a pedestrian signal and a pedestrian green flash signal.

As can be seen from FIG. 4, the chain family 19 is the sub-Wang chain family. The traffic flow chain with the minimum loss time belongs to the chain family 19. However the average value of the cycle loss time of the chain family 19 is −4.375 seconds and not the minimum, and a positive value of the cycle loss time may occur. Of course, if the traffic flow chain with the minimum cycle loss time can be selected according to pre-designed flow rate $\{Q_j\}$ in each time slice, this chain family may be considered in a time-slice timing control unrelated to dynamical adjustment of a scheme.

The average value of the cycle loss time of the chain family 12 is −9.75 seconds and is the minimum, thus the chain family 12 is the Wang chain family which should be preferably selected. Compared with the 2-phase-stage scheme in which various traffic flows are released by way of mixing, the traffic order thus obtained is better and safer and can achieve a faster traffic speed.

In the adjustment of the multi-phase scheme, if only the cycle length and green light timing are changed but the basic phase stage structure and the phase stage sequence are not changed, i.e. the chain family is not changed, the key traffic flow chain and the corresponding cycle loss time may be changed only in the same chain family and there may be no structural transition, thus there is no need for a transition scheme.

In a equal saturation timing scheme in which various constraints are all meet, the minimum chain length of a key traffic flow chain is maximized, which may reach or approximately equal to the cycle. By setting the early-on or late-off or overlapping stage for some frame vehicle flows, the green intervals of all the traffic flow of the key traffic flow chain can reach or approximately equal to their minimum green intervals respectively. In this way, the task for finding the key traffic flow chain is changed to find a traffic flow chain with the maximum value of the minimum chain length and to find the time cycle for the scheme via the minimum chain length of the key traffic flow chain.

The present application provides the above mentioned traffic signal control method, including selecting and determining a control scheme for a basic phase structure and a sequence structure:

(1) selecting a basic phase structure and a sequence structure of at least one of chain families with the minimum average values of the cycle loss time;

(2) achieving that the green time is equal to or greater than Wang minimum green time $\{G_{mi}\}$ and the green intervals is equal to or greater than the minimum green interval; drawing a chain family diagram and determining an adjustable green interval, an adjustable green time and a minimum compatible scheme $\{I_i\}$; calculating the total sum of the flow rate ratios of each of traffic flow chains in the chain family according to the number $\{n_i\}$ of the traffic flows and traffic lanes, a saturated flow rate $\{Q_{si}i\}$ of the traffic lane, flow rate requirement $\{Q_i\}$ of the traffic flow and the maximum saturation requirement q, and obtaining the maximum total sum of the flow rate ratios Y; denoting, by L', the cycle loss time in a path in which the total sum of the flow rate ratio is maximum in the chain family;

(3) if L' of some of the chain families are not greater than 0, determining green light timing schemes and key paths only for chain families with L'<0, and calculating the cycle loss time for the obtained schemes, selecting a scheme whose ratio of the cycle loss time to the cycle is relatively smaller and running this scheme, otherwise continuing the step; and (4) determining green light timing schemes and key paths, and calculating the cycle loss time for the obtained schemes, so as to select a scheme whose ratio of the cycle loss time to the cycle is relatively smaller and running this scheme.

If the timing design is only performed on the Wang chain family, the control scheme may substantially have comparatively smaller cycle loss time for various traffic flow rate requirements, and there is a very strong robustness for speed reduction. If all of the cycle loss times in the Wang chain family are negative, it can be ensured that the cycle loss time can become negative by dynamically adjusting the timing or the scheme for the Wang chain family regardless of the change of the traffic requirement.

Additionally, the method for determining the minimum compatible scheme includes the calculations herein. If the sum of the minimum green intervals indicated by parallel straight line arrows is equal to the sum of the minimum green intervals indicated by intersecting oblique lines between the two groups of the nodes in the chain family diagram, corresponding 4 green intervals are said to be compatible. Any of the control schemes all belong to the compatible schemes.

Some green intervals may be appropriately added to 4 incompatible green intervals to make them become compatible. There must be a compatible scheme where the total sum of the added green intervals is a minimum, and this compatible scheme is referred to as a minimum compatible scheme for short. There is not only one minimum compatible scheme. The appropriately added green interval is referred to as an adjustable green interval. Moreover, in various minimum compatible schemes, there is a scheme in which the green interval corresponding to any one of the minimum green interval constrain arc does not increase any more.

The present application provides the above mentioned traffic signal control method, including adjusting a minimum compatible scheme:

1) recoding two minimum green intervals with the smaller sums as an initial time, if the sum of the minimum green intervals indicated by parallel straight line arrows is different from the sum of the minimum green intervals indicated by intersecting oblique lines between the two groups of the nodes in the chain family diagram;

2) recording one of the two minimum green intervals with the smaller sums which appears many times in the key traffic chain as a first green interval, adding a predetermined value to a second green interval and adjusting the first green interval, so that the sums of the first green intervals is equal to that of the second green intervals;

calculating, for each traffic chain of the chain family, the sum of the Wang minimum green time $G_{mk}$ and the green intervals of the traffic flows as the minimum chain length of the traffic chain, and setting a traffic chain with the maximum value of the minimum chain length from the chain family as a key traffic chain, in which the maximum value of the minimum chain length is a first cycle time $C_0$;

judging whether the first green interval is equal to or smaller than the initial time corresponding to the first green interval or not, performing 3) if so; otherwise performing 2);

3) the first green interval being the minimum green interval, adjusting other green intervals so that the sum of the minimum green intervals indicated by parallel straight line arrows is equal to the sum of the minimum green intervals indicated by intersecting oblique lines, adjusting a minimum green time set $\{G_{mk}\}$ so that the total sum of the set and the minimum green intervals prior and posterior the traffic flow is smaller than the minimum green interval between the traffic flows prior and posterior the traffic flow; using each of the green intervals of the compatible scheme obtained in the designing to the control scheme.

Figure 7:
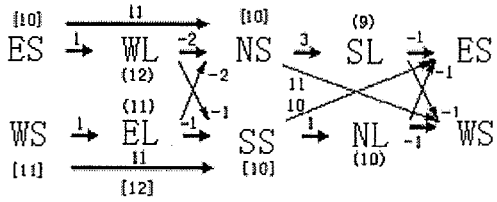
FIG. 7 illustrates a Wang chain family compatible scheme of the intersection illustrated in FIG. 1.

In a third embodiment the minimum compatible scheme of the Wang chain family for the intersection shown in FIG. 1, $\{I_i\}$: $I_1=1$ s, $I_2=-2$ s, $I_2=-1$ s, $I_3=3$ s, $I_4=-1$ s, $I_4=-1$ s, $I_5=1$ s, $I_6=-1$ s, $I_6=-2$ s, $I_7=1$ s, $I_8=-1$ s, $I_8=-1$ s, $I_{1,3}=11$ s, $I_{5,7}=11$ s, $I_{7,1}=12$ s, $I_{3,5}=12$ s, as shown in FIG. 7.

Figure 5:
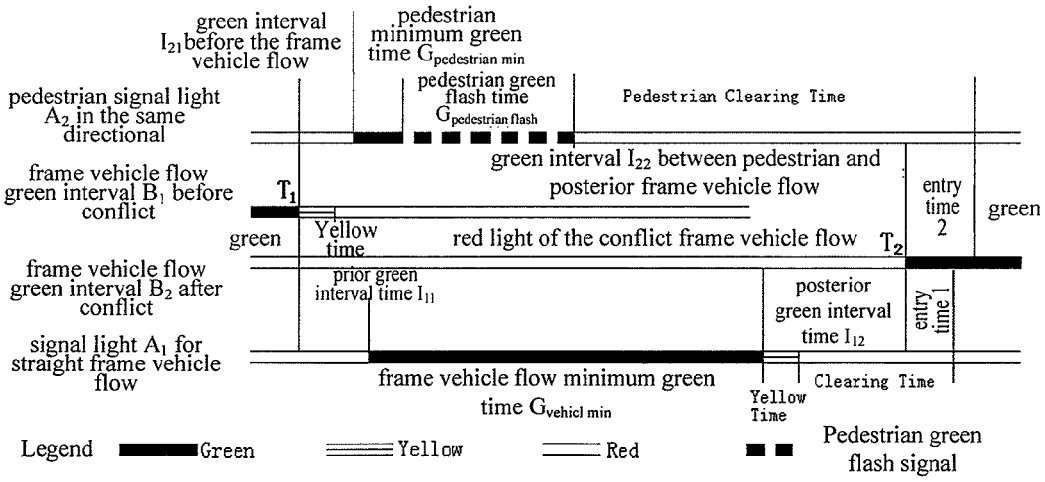
FIG. 5 is an illustrative relationship diagram of a Wang minimum green time of a straight going vehicle in the case of a pedestrian going across a street.

A method for determining Wang minimum green time includes the steps as following as statistical regularity indicates that there are large differences among the speed of the pedestrians due to gender, age and physical condition. Population in various speeds has the right to go across a street safely, and a simple processing using a uniform average speed should not be adopted. Population in various speeds should be defined according to the statistical regularity as follows. Population in a speed larger than a certain threshold, such as 1.5 m/s, is referred to as fast people, and population in a speed about 11.0 m/s is referred to as general people. The time spent for a pedestrian going across a street includes: pedestrian green time, pedestrian green flash time and pedestrian clearing time. A pedestrian green light is a passing signal, and children, the elderly or slow people with disabilities in need of care all enter into a crosswalk only when the green light is begin to turn on. The general people have to enter into the crosswalk during the green light cycle. The pedestrian green flash is a warning signal for indicating that the red light is going to be turned on, and only the fast people are allowed to enter into the crosswalk during the green flash cycle. A red light forbids any people from entering into the crosswalk; the pedestrian having entered into the crosswalk should pass through a conflict area as fast as possible to enter into a safe area ahead. No matter whether the green light is turned on, all the conflict vehicles need to stop and give way to pedestrians as long as there are pedestrians walking at the crosswalk. The time duration of the pedestrian green flash signal together with the fast people clearing time posterior the green flash signal can ensure the general people that have entered into the crosswalk can safely reach the other end of the crosswalk when the green light is turned off and thus is the clearing time for the general people. The fast people clearing time posterior the green flash signal can ensure the fast people that have entered into the crosswalk can safely reach the other end of the crosswalk when the green light is turned off. Basically, the pedestrian minimum green time $G_{pedestrian\ min}$ is generally not smaller than 3 seconds in the green light cycle. There may not be slow people every time and the safety of going across a street for the slow people mainly relay on vehicles which give way, thus there is no need to increase the length of the minimum green time, as shown in FIG. 4. Also, as shown in FIG. 5, there is an illustrative relationship diagram of a Wang minimum green time of the straight going vehicle in the case of a pedestrian going across a street;

The present application provides a method for designing the above mentioned traffic signal control system, including determining Wang minimum green time, in which a maximum one from the group consisting of 3 seconds, a first green time and a second green time is set as the minimum green time for a traffic flow;

where the method for determining the first green time including:

subtracting the sum of compatible green intervals prior and posterior the traffic flow from a minimum green interval between a prior traffic flow and a posterior traffic flow in the traffic flow chain to give the first green time;

and where the second green time is as follows:

$$G=G_{pedestrian}+G_{pedestrian\ flash}+(I_{21}+I_{22})-(I_{11}+I_{12}) \quad (10)$$

where $G_{pedestrian}$ is a minimum green time of the pedestrian traffic flow in the same direction as the traffic flow;

$G_{pedestrian\ flash}$ is a difference between the time needed when general people passing through the clearing distance with a normal walking speed and the time needed when fast people passing through the clearing distance with a speed faster than a certain threshold, based on the clearing distance for the pedestrian traffic flow $$G_{pedestrian\ flash}=\text{“general people” clearing time}-\text{“fast people” clearing time} \quad (11)$$

$I_{21}$ is a minimum green interval between the pedestrian traffic flow and a traffic flow prior the traffic flow, $I_{22}$ is a minimum green interval between the pedestrian traffic flow and a traffic flow posterior the traffic flow, $I_{11}$ is a minimum green interval between the traffic flow and the prior traffic flow, and $I_{12}$ is a minimum green interval between the traffic flow and the posterior traffic flow.

It is observed that the Wang minimum green time is equal to or greater than the conventional minimum green time. Moreover, the cross stage minimum green time of the cross stage traffic flow chain is already used by the cross stage traffic flows and thus should not be included in the system lost time any more. Therefore there is no need to consider the cross stage traffic flow chain anymore and complex cumbersome calculation can be omitted and avoided.

A fourth embodiment is described as follows, and referring to FIG. 1, the road width is 36 m and there is a safety island of 8 square meters in the middle. Therefore the maximum travel distance is 14 m, i.e. half of the road width. In case that the pedestrian minimum green time is 3 s, the speed of the general people is 1.0 m/s and the speed of the “fast people” may be equal to or greater than 1.5 m/s, it can be determined that the pedestrian green flash time is 4 s and the minimum green time $\{G_{mi}\}$ of the frame vehicle flows are as follows: $G_{m1}=9$ s for east straight, $G_{m2}=12$ s for west left, $G_{m3}=10$ s for north straight, $G_{m4}=9$ s for south left, $G_{m5}=11$ s for west straight, $G_{m6}=11$ s for east left, $G_{m7}=10$ s for south straight and $G_{m8}=10$ s for north left.

Determining the control method in the case of $L'<0$, is as follows, and in some studies the focus on the case of $L'>0$, however the conventionally determined control method fails in the case of $L'<0$. In the present application, the path with the maximum total sum of the flow rate ratios Y is not necessarily the key path in the family chain, since there is no consideration for the effect of the minimum green interval. In the case of $L'<0$, for a possible minimum cycle $C_0$ including the minimum green time, if $1-L'/C_0 \geq Y$, the flow rate requirement is definitely greater than the traffic capacity of the intersection, and only a scheme with the minimum cycle $C_0$ can be selected to release the traffic flow with the maximum releasing capacity until the traffic is mitigated; otherwise, there may be a solution, then when the actual traffic flow rate requirement $\{Q_i\}$ and the rational maximum saturation degree requirement q are satisfied as much as possible, the cycle $C_0$ and the effective green time $G_{ei}$ of the key traffic flows are gradually increased from the possible minimum cycle with a constant non-key effective green time $G_{ei}$, so that the cycle $C_0$ and the effective green time $G_{ei}$ can meet the split requirement $\{\lambda_i\}$. The green time $G_i$ and the minimum cycle $C_0$ of the traffic flows in the key path of the designed signal control system is met early, and then green light on and off time frame and other parameters of each of the frame traffic flows are determined. However, when the possible cycle value is larger than an expected maximum cycle during the successive solving process from small to large, critical saturation is reached and the flow rate requirement is approaching the traffic capacity of the intersection. In this case, only the obtained maximum cycle scheme can be selected, so as to release the traffic flow with the ratio requirement being met as much as possible until the traffic is mitigated, although some traffic flows with big flow rate may not be all released. Since $L'<0$, the necessary condition inequality for solution $1-L'/C_0 \geq Y$ actually allows to a certain degree that the maximum total sum of the flow rate ratios $Y>1$, thus the upper limit of the allowed total sum of the flow rate ratios is greatly increased, and the cycle has the upper limit $-L'/(Y-1)$.

The present application provides a control method for the above mentioned traffic signal control system, which includes the following steps. The following control scheme design is performed on the selected chain family:

1) determining a split requirement $\{\lambda_i\}$ for the frame vehicle flow according to the equal saturation, wherein $\lambda_i = Q_i/qn_iQ_{si}$; if $L' \geq 0$, giving the maximum allowed cycle C;

2) starting with the Wang minimum green time set $\{G_{mi}\}$ and the minimum compatible scheme $\{I_i\}$ and moving on to the next step;

3) calculating the minimum chain length for the traffic flow chain in the chain family, and setting the maximum value of the minimum chain length as a minimum cycle time $C_0$ to be selected;

4) if $Y>1-(L'/C_0)$ which means a super-saturation, setting $\{G_i\}=\{G_{mi}\}$ and moving on to 8), otherwise moving on to the next step;

5) assigning corresponding an integer green time $\{G_i\}$ for the frame vehicle flow by using $C_0$ according to the following equation:

$$G_j = \mathrm{Max}\{C_0\lambda_j - A + l, G_{mj}\} \tag{12}$$

where $\lambda_j$ is the split requirement of the frame vehicle flow j; $G_j$ is the green time of the traffic flow; A is the yellow time; l is the start-up loss time; $C_0$ is the cycle; and $G_{mj}$ is the minimum green time;

moving on to 8) if the $\{G_i\}$ is equal to the previous $\{G_i\}$ or $\{G_{mi}\}$; otherwise making $\{G_i\}=\{G_{mi}\}$ and moving on to the next step;

6) substituting the green time set $\{G_i\}$ into the equation calculating the minimum chain length for the traffic flow chain to obtain the maximum value of the minimum chain length as a cycle time $C_1$;

7) moving on to the next step if the cycle time $C_1 \leq C_0$; otherwise making $C_0=C_1$, and if $C_0$ is larger than an expected maximum cycle, i.e. $C_0 \geq -L'/(Y-1)$ when $L'<O$ and $Y>1$, or $C_0$ is larger than a given maximum allowable cycle C when $L' \geq 0$, which means critical saturation, moving on to the next step; otherwise returning to 5);

8) with the integer green time set $\{G_i\}$ and the minimum compatible schemes $\{I_i\}$ for the key frame vehicle flow related to the maximum value of the minimum chain lengths being as the minimum frame, increasing the integer green time for other frame vehicle flows so as to fulfill the gap of the chain family diagram and determining the chain family scheme and determining the green light on and off time frames for each of the frame vehicle flows;

9) comparing the green time $\{G_i\}$ and the green intervals $\{I_i\}$ corresponding to the chain family schemes, determining each of the derivative phase stages formed because the green light turns on early or turns off late or overlaps and determining each of the phase stage time and phase intervals;

10) with the minimum green interval being a constraint, determining the early-on time and late-off time of traffic flow green lights for pedestrians, non-motor vehicles and right-turn vehicles, and configuring the green time, where a traffic flow with a larger flow rate is given a relatively longer green time under the premise of the guarantee that the traffic flow green lights of pedestrians, non-motor vehicles and right-turn vehicles all exist;

11) drawing a signal light group-phase stage diagram, verifying and putting each timing data into operation; sending the timing data to each of the display apparatuses for displaying.

Figure 14:
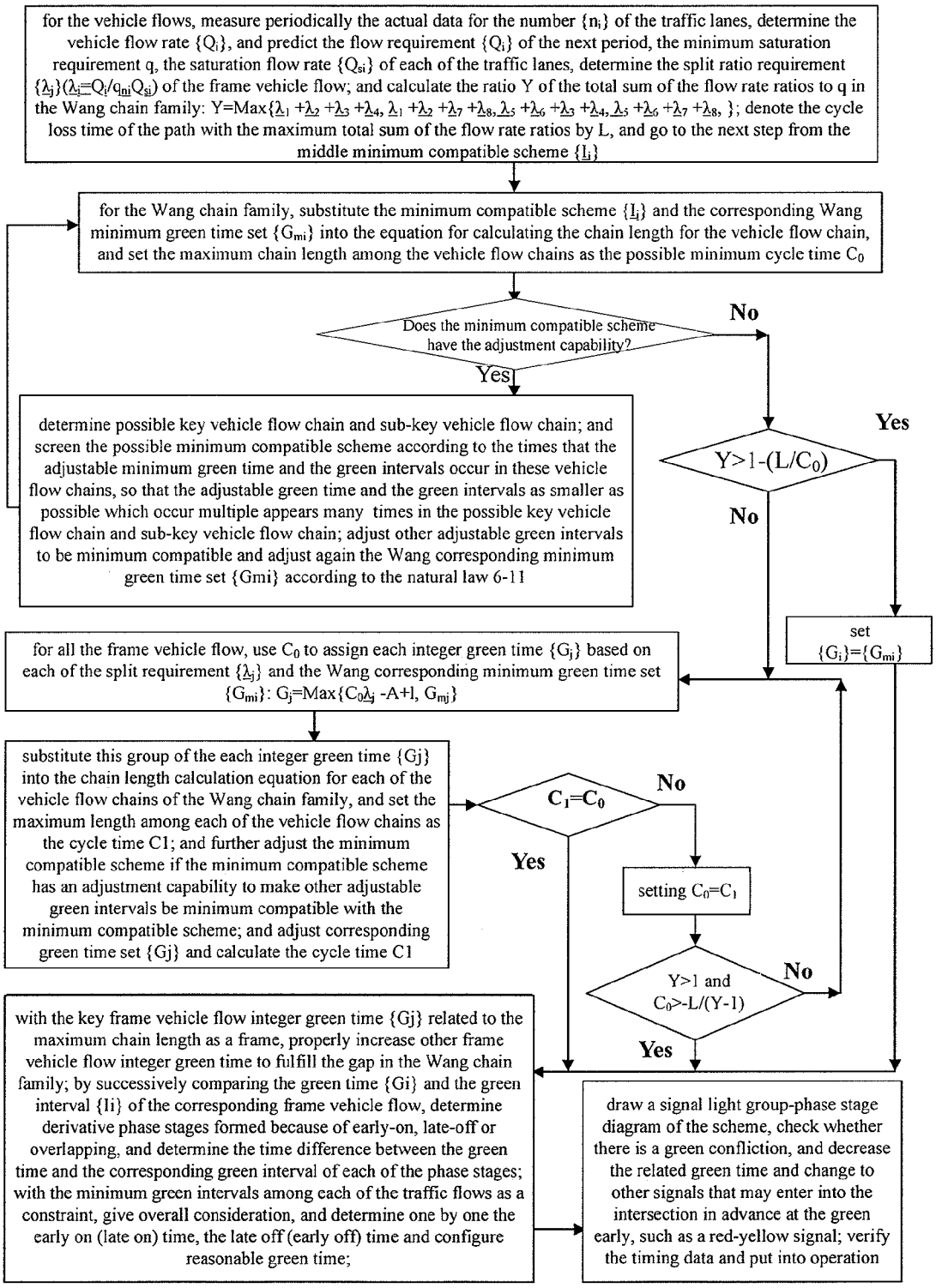
FIG. 14 is a flow chart for designing a signal control scheme.

In a fifth embodiment, determining the minimum cycle and the key traffic flow chain according to the traffic flow rate requirement $\{Q_i\}$ may be found in the flow chart for designing a signal control scheme is as shown in FIG. 14. The following operations are performed on the Wang chain family.

1) Determining split requirement $\{\lambda_i\}$ of the frame vehicle flow according to the designed flow rate set $\{Q_i\}$ The designed flow rates are respectively as follows: $Q_1=778$ vehicles/hour for east straight, $Q_2=475$ vehicles/hour for west left, $Q_3=835$ vehicles/hour for north straight, $Q_4=374$ vehicles/hour for south left, $Q_5=893$ vehicles/hour for west straight, $Q_{6=432}$ vehicles/hour for east left, $Q_7=835$ vehicles/hour for south straight and $Q_{8=403}$ vehicles/hour for north left. The saturation flow rate of the single traffic lane is $Q_{si}=1600$ vehicles/hour, $i \in 8$. The yellow time for all flow directions is A=4 s. The loss time for all flow directions is 1=1.5 s. The maximum allowable saturation q=0.9. The split requirement for each of the flow directions may be determined as follows: $\lambda_1=0.27$; $\lambda_2=0.33$; $\lambda_3=0.29$; $\lambda_4=0.26$; $\lambda_5 0.31$; $\lambda_6=0.30$; $\lambda_7=0.29$; $\lambda_8=0.28$.

2) Setting the maximum value of the minimum chain length of the traffic flow chains as a possible minimum cycle time $C_0$ according to the minimum green time, i.e.

$$C_0 = \mathrm{Max}\{\Sigma_{i=1}^{4}(G_{mi}+I_i), G_{m1}+I_1+G_{m2}+I_2+G_{m7}+I_7+G_{m8}+I_8, G_{m5}+I_5+G_{m6}+I_6+G_{m3}+I_3+G_{m4}+I_4, \Sigma_{i=5}^{8}(G_{mi}+I_i)\} = \mathrm{Max}\{41,41,42,42\} = 42\ \mathrm{s}$$

It is found from the calculation for the possible minimum cycle $C_0$ that the possible key traffic flow chain is the chains 3 and 4 which can not be adjusted. The total sum Y of the maximum flow rate ratios of the Wang chain family is verified:

$$\begin{aligned} Y &= \mathrm{Max}\{\lambda_1+\lambda_2+\lambda_3+\lambda_4;\ \lambda_1+\lambda_2+\lambda_7+\lambda_8;\\ &\quad \lambda_5+\lambda_6+\lambda_3+\lambda_4;\ \lambda_5+\lambda_6+\lambda_7+\lambda_8;\\ &= \mathrm{Max}\{1.15;\ 1.17;\ 1.16;\ 1.19\} = 1.19; \end{aligned}$$

if $L'$ denotes the cycle loss time of the path with the maximum total sum of flow rate ratios, then $L'=-10<0$; it is checked that $1-(L'/C_0)=1+10/42=1.238>Y$, and therefore there may be a solution.

The cycle is $C_0=42<-L'/(Y-1)=10/0.19=52.6$, and this is why not an analytical method is used to directly set $C_0=52$. The search begins from the minimum possible cycle $C_0=42$, and it is possible to obtain the solution for the minimum cycle.

3) Taking the green time for each of the traffic flows

Assigning the green time respectively as follows according to the expression (12): $G_1=9$, $G_2=12$, $G_3=10$, $G_4=9$, $G_5=11$, $G_6=11$, $G_7=10$, $G_8=10$.

4) Comparing $\{G_i\}$ with $\{G_{mi}\}$, and moving on to 6) if there is no change; otherwise calculating the maximum value of the minimum chain length of the traffic flow chains as a minimum cycle time $C_1$ according to assignment result, i.e.

$$C_1=\mathrm{Max}\{\Sigma_{i=1}^{4}(G_{mi}+\underline{I_i}),G_{m1}+\underline{I_1}+G_{m2}+\underline{I_2}+G_{m7}+\underline{I_7}+G_{m8}+\underline{I_8},G_{m5}+\underline{I_5}+G_{m6}+\underline{I_6}+G_{m3}+\underline{I_3}+G_{m4}+\underline{I_4},\Sigma_{i=5}^{8}(G_{mi}+\underline{I_i})\}.$$

5) performing the step 6) if the cycle time $C_1 \leq C_0$; otherwise making $C_0=C_1$ and returning to the step 3).

6) Determining the ratio of the cycle loss time to the cycle for the key traffic chain with the cycle time $C_1$; in the present embodiment, the key path is the traffic chain 4 and the cycle loss time is −10 s, the ratio of the cycle loss time to the cycle is −0.238, therefore the cycle is set to be $C_0$=42 s.

7) Further determining the key traffic flow chain and the green time for the key traffic flows and the minimum compatible scheme while determining the cycle, and improving the scheme according to this scheme frame and expanding the integer green time set $\{G_i\}$ of each of the non-key traffic flows until the gaps in the chain family diagram is fulfilled, there exists $G_1$=10 s, thus the timing frame scheme for the intersection in FIG. 1 is: $G_1$=10, $G_2$=12, $G_3$=10, $G_4$=9, $G_5$=11, $G_6$=11, $G_7$=10, $G_8$=10;

the saturation $q_i$ of each of the frame vehicle flows are respectively as follows: $q_1=C_0Q_1/(G_1+2.5)n_1Q_{s1}=0.817$, $q_2=0.860$, $q_3=0.877$, $q_4=0.854$, $q_5=0.868$, $q_6=0.840$, $q_7=0.877$, $q_8=0.846$, the rationally allowable maximum saturation degree is q=0.9;

8) Accurately operating the chain family scheme by controlling the time at which the green light is turned on and the operation time duration of each of the signals via a signal controller, in which the chain family scheme with the determined green time and the determined green interval has one-to-one correspondence with the scheme for controlling the frame vehicle flow by the traffic signal, and is another expression form of the scheme for controlling the frame vehicle flow by the traffic signal.

The Wang chain family scheme further includes 24 kinds of frame vehicle flow signal control schemes including the derivative phase stages formed because of the early-on or late-off or overlapping, besides the signal control scheme of the frame vehicle flow including the basic phase stages.

The phase stage time of the signal control scheme of the frame vehicle flow is denoted by $\underline{G_i}$, $i\in\underline{4}$; the phase interval is denoted by $T_i$, $i\in\underline{4}$; the possibly existing overlapping stage time is $G'_i$; the phase intervals prior and posterior the time $G'_i$ are denoted by $T_i$ and $T'_i$, $i\in\underline{4}$; the early-on time of the frame vehicle flows is denoted by $T_{i1}$, $i\in\underline{8}$; and the late-off time of the frame vehicle flows is denoted by $T_{i2}$, $i\in\underline{8}$;

By successively comparing the green time $\{G_i\}$ and the corresponding green interval $\{\underline{I_i}\}$, the time difference between the green time $\{G_i)\}$ and the corresponding green interval $\{\underline{I_i}\}$ may be determined and the determined chain family scheme corresponds to the signal control scheme of the frame vehicle flow including which derivative phase stage.

For all of the $i\in\underline{4}$, only one of a pair of the early-on time $\{T_{i1}, T_{(i+4)1}\}$can exist, and only one of a pair of the late-off time $\{T_{i2}, T_{(i+4)2}\}$can exist, the early-on time and the late-off time which do not exist are taken as 0.

1) the phase stage time is obtained by subtracting the possibly existing early-on time and late-off time from the green time:

$$\underline{G_i}=G_i-T_{i1}-T_{i2}=G_{i+4}-T_{(i+4)1}-T_{(i+4)2},\ i\in\underline{4} \tag{13}$$

2) for the phase interval without an oblique direction green interval constrain, $$T_{i2}+\underline{I_i}=T_{(i+5)1}+\underline{I_{(i+4)}},T_{(i+4)2}+\underline{I_{(i+4)}}=T_{(i+1)1}+\underline{I_i},i\in\underline{4} \tag{14}$$

and the phase interval is $$T_i=\mathrm{Max}\{T_{(i+1)1}+\underline{I_i},T_{i2}+\underline{I_i}\},i\in\underline{4} \tag{15}$$

if $T_{i2}>\underline{I_{(i+4)1}}$ or $T_{(i+4)2}>\underline{I_i}$, there is an overlapping phase stage and the time duration of the overlapping phase stage is:

$$G'_i=T_{i2}-\underline{I_{(i+4)}} \text{ or } G'_i=T_{(i+4)2}-\underline{I_i},i\in\underline{4} \tag{16}$$

the phase intervals $T_i$ and $T'_i$ prior and posterior the overlapping phase stage are respectively $\underline{I_i}$ and $\underline{I_{(i+4)1}}$;

3) for the phase interval with the oblique direction green interval constrain, $$T_{i2}+\underline{I_i}=T_{(i+5)1}+\underline{I_{(i+4)}}=\underline{I_{(i+4)'}}+T_{(i+1)1}=I_{(i+4)2}+\underline{I_{i)'}} \tag{17}$$

$$\underline{I_i}+T_{(i+1)1}=\underline{I_i}+T_{(i+5)1}=T_{(i+4)2}+\underline{I_{(i+4)}}=T_{(i+4)2}+\underline{I_{(i+4)'}},i\in\underline{4} \tag{18}$$

the phase intervals prior and posterior the phase interval is:

$$T_i=\mathrm{Max}\{T_{(i+1)1}+\underline{I_i},T_{i2}+\underline{I_i}\}i\in\underline{4} \tag{19}.$$

The signal control frame vehicle flow scheme is determined, and the parameter comparison and calculation for the derivative phase stage are shown in Table 5:

TABLE 5 the parameter comparison and calculation for the derivative phase stage for the intersection shown in FIG. 1

| compar. level | comparison parameter | | determining early-on time and late-off time(s) | | phase stage time | phase interval |
|---|---|---|---|---|---|---|
| 1 | $I_4=-1$ | $I_4=-1$ | $G_1$ normally on, $T_{11}=0$ | $G_5$ normally on, $T_{51}=0$ | | $T_4=-1+T_{42}$ |
| 2 | $G_1=10$ | $G_5=11$ | $G_1$ normally off, $T_{12}=0$ | $G_5$ late off, $T_{52}=1$ | $G_1=10$ | |
| 3 | $I_1=1$ | $I_5+T_{52}=2$ | $G_2$leading green, $T_{21}=1$ | $G_6$ normally on, $T_{61}=0$ | | $T_1=2$ |
| 4 | $G_2-T_{21}=11$ | $G_6=11$ | $G_2$ normally off, $T_{22}=0$ | $G_6$ normally off, $T_{62}=0$ | $G_2=11$ | |
| 1 | $I_2=-2$ | $I_6=-1$ | $G_3$leading green, $T_{31}=1$ | $G_7$ normally on, $T_{71}=0$ | | $T_2=-1$ |
| 2 | $G_3-T_{31}=9$ | $G_7=10$ | $G_3$ normally off, $T_{32}=0$ | $G_7$ late-off green, $T_{72}=1$ | $G_3=9$ | |
| 3 | $I_3=3$ | $I_7+T_{72}=2$ | $G_4$ normally on, $T_{41}=0$ | $G_8$ early-on green, $T_{81}=1$ | | $T_3=3$ |
| 4 | $G_4=9$ | $G_9_T_{81}=9$ | $G_4$ normally off, $T_{42}=0$ | $G_8$ normally off, $T_{82}=0$ | $G_4=9$ | $T_4=-1+T_{42}=-1$ |
| | cycle | $\Sigma(G_j+T_i)$ | 10 + 11 + 9 + 9 + 2 − 1 + 3 − 1 = 42 | | | satisfied |

In the timing scheme for the intersection shown in FIG. 1, the time of each of the phase stage is: 10 s, 11 s, 9 s and 9 s, the phase intervals are: 2 s, −1 s, 3 s and −1 s, the time of the phase stage for the west left and the north straight are turned on earlier by 1 s and the time of the phase stage for the west straight and the south straight are turned off later by 1 s, and there is no overlapping phase stage.

Figure 8:
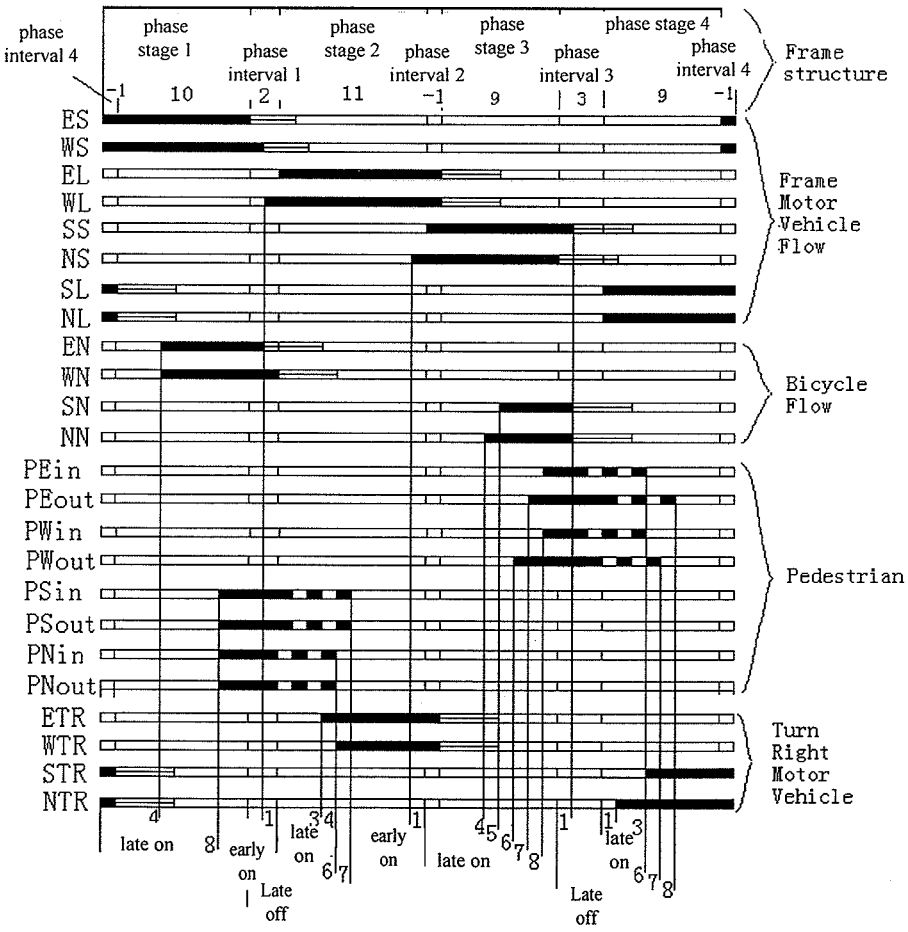
FIG. 8 is a signal light group-phase stage diagram of a control scheme for the intersection illustrated in FIG. 1, where a blank space between two phases indicates a phase interval, a thick black solid line ▬ in each phase indicates a green light, a blank space ⌣ indicates a red light, a thin straight line ___ indicates a yellow light and a thick dashed line ▪ ▪ indicates a pedestrian green flash signal.

9) With the minimum green interval being a constraint, determining the early-on or late-on time and the early-off or late-off time of traffic flow green lights for the pedestrians, the non-motor vehicle and the right-turn vehicle, and configuring the green time, in which a traffic flow with a larger flow rate is given a relatively longer green time under the premise of the guarantee that the traffic flow green lights of the pedestrians, the non-motor vehicle and the right-turn vehicles all exist;

10) Drawing a signal light group-phase stage diagram, as shown in FIG. 8. In this way, the design of the traffic signal control scheme in the present embodiment is completed. Each timing data is verified and put into operation, and is sent to each of the display apparatuses for displaying.

The minimum green interval is a kind of time constraint transformation which converts the conflict at the key conflict point into traffic flow passing through the stop line of the intersection. The conventional signal controller standard in which the "forbidden green confliction" may confuse the concept of conflict should be abandoned. Must not cause that the traffic signal control scheme is affected by a signal controller with wrong detection function.

6. The present application provides the above mentioned traffic signal control method in which the road channelization scheme for the intersection and the calculated minimum green interval are screened by the following method.

The minimum average value of the cycle loss time is determined respectively for each of at least two road channelization schemes for the intersection, and the road channelization scheme with the minimum average value of the system loss is selected as the road channelization scheme for the intersection, and the information of the selected road channelization scheme and the calculated minimum green interval are output.

In different channelization schemes, there may be critical points at different positions and different clearing lengths and entry lengths, and the minimum green intervals and the average values of the cycle loss time of the Wang chain family are different. The average values of the cycle loss time of the Wang chain family may be used as a preferable numerical index for screening the channelization schemes. The Wang channelization with relatively smaller average values are screened and found. In the present application, a road channelization in which all of the cycle loss time of the Wang chain family are negative is referred as the Wang channelization. Does the Wang channelization certainly exist?See FIG. 7.

The present application provides the above mentioned traffic signal control system which further includes the road channelization scheme for the intersection: the road channelization scheme used for the intersection including an annular road and a road intersecting the annular road, in which the annular road is used for the straight going vehicle and the non-motor vehicle, and the center area inside the annular road is the straight going vehicle forbidden area; the road intersecting the annular road and the center area is used for left-turn vehicles and form a grade intersection with the annular road for the straight going motor vehicles.

Figure 9:
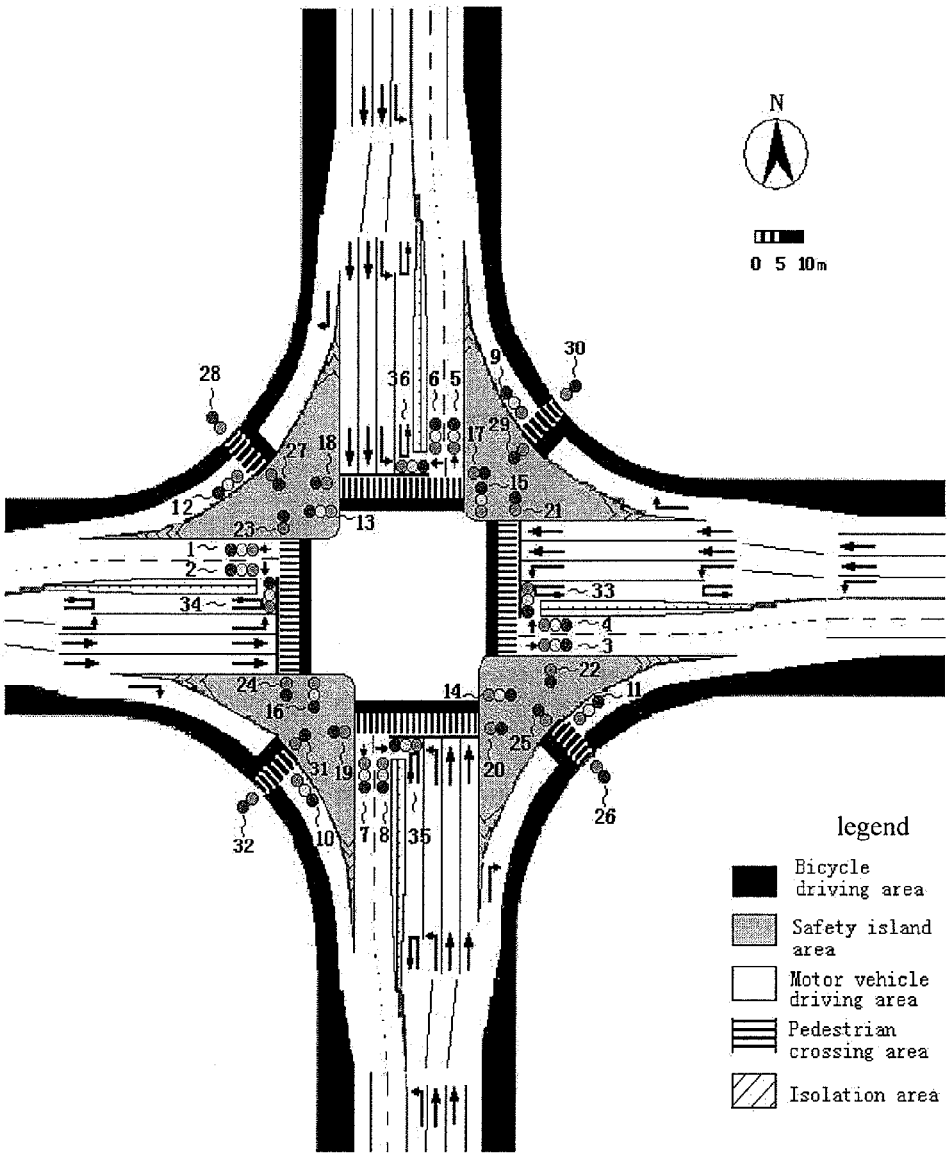
FIG. 9 illustrates a conventional standard channelization scheme for an intersection.
Figure 12:
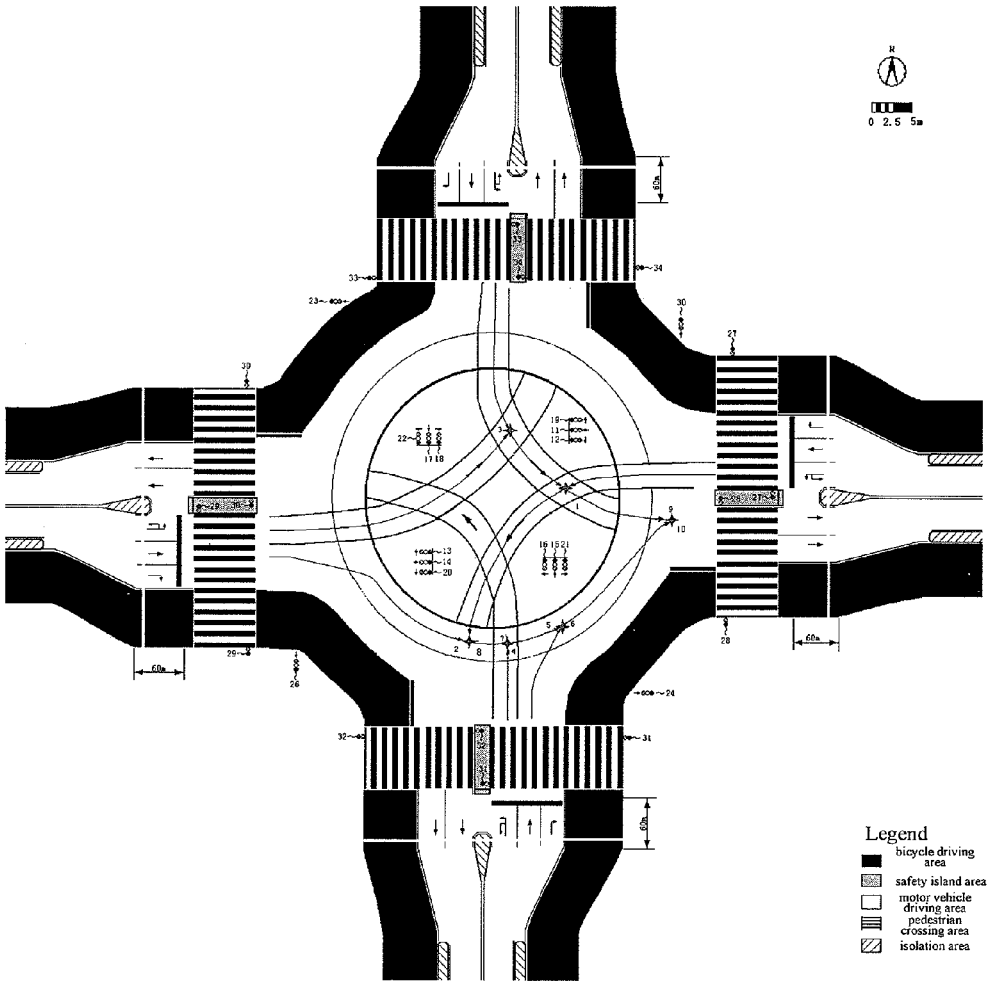
FIG. 12 shows a Wang channelization scheme for an upper (lower) intersection of a through bridge.
Figure 13:
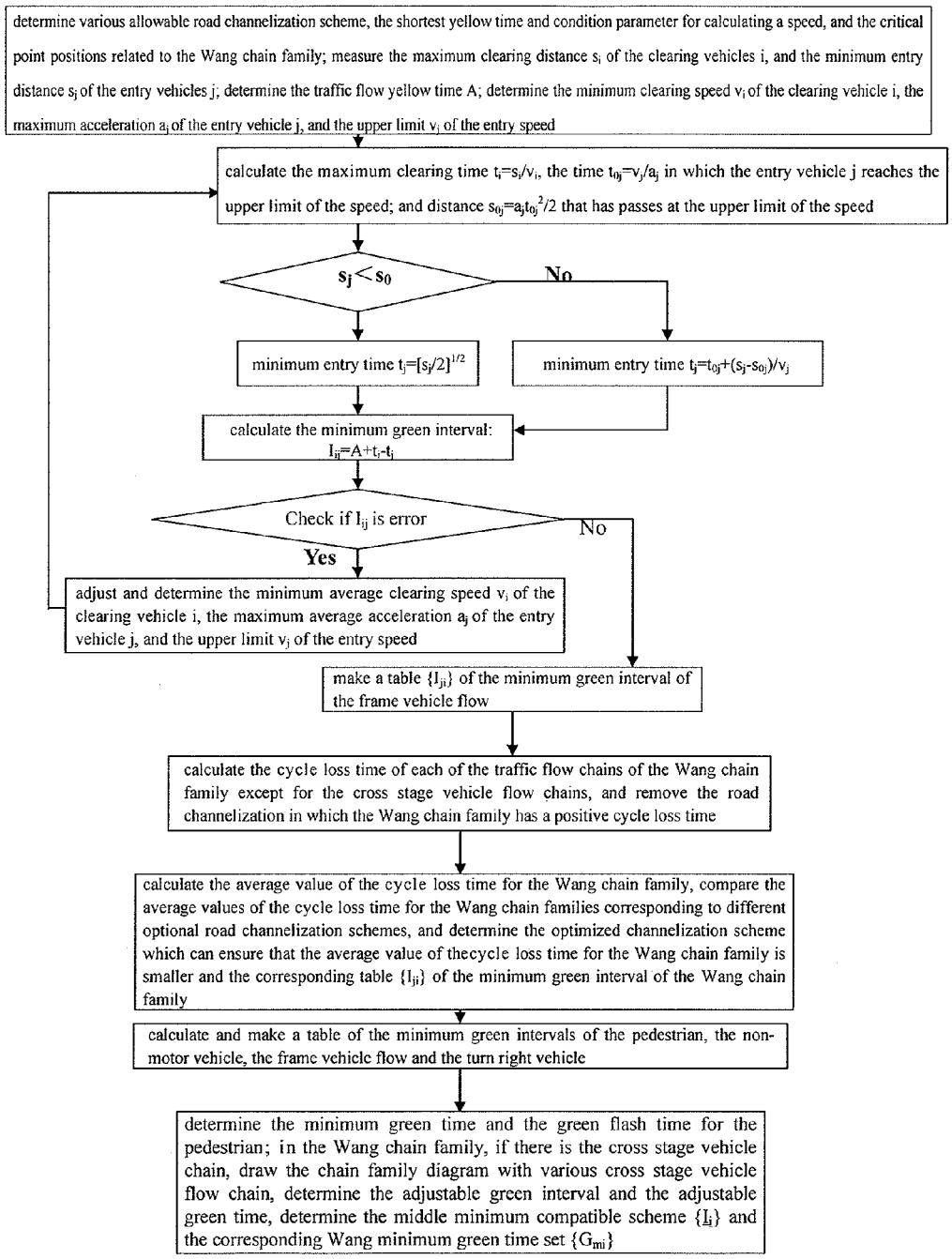
FIG. 13 is a design flowchart for screening and adopting a Wang channelization scheme.

In a sixth embodiment, screening the available road channelization schemes based on the cycle loss time of the Wang chain family. Various possible road channelizations are compared, and selected by using the fact that makes the cycle loss time of the Wang chain family smaller as an index. The design flowchart for screening and adopting the Wang channelization scheme is shown in FIG. 13. It is conventional to apply the standard channelization as shown in FIG. 9 to a grade intersection (bridge) at which it is impossible to build an overpass. However the standard channelization for the intersection as shown in FIG. 9 does not belong to the Wang channelization scheme. Digital data is the most convincing. The calculated digital result indicates that the Wang chain family is chain family 12 in the intersections in FIG. 1 and FIG. 9. However, the average value of the Wang chain family in FIG. 9 is only 0, which is quite large than that in FIG. 1. Therefore FIG. 1 belongs to the Wang channelization scheme. The technical solution of the present application may also be applied to an intersection under a through bridge, as shown in FIG. 1. The technical solution of the present application may also be applied to a small intersection, even a small intersection with only two traffic lanes i.e. the traffic lane in two directs, as shown in FIG. 12.

Further, for a countdown display, in table 4, in the case that the total sum of the start-up loss time is 4.0 which is greater than the Wang channelization threshold S=3.75, the cycle loss times of the traffic flow chains in the Wang chain family in FIG. 1 are respectively 0, 0, 1, 0, thus it can not be a Wang channelization scheme. Of course, the threshold S=3.75 is related to specific speed parameters of the specific intersection, which must be satisfied to ensure that the existence of the Wang channelization. The present application provides the above mentioned traffic signal control method which further includes: using a countdown display to synchronously continuously degressively display by seconds the remaining time determined by a corresponding signal of a light signal at least during the last 5 or 6 seconds.

The countdown display is provided near the signal light so as to provide timely an information induced help about the remaining time from the time when the signal is off. Thus the drivers can decide by themselves when to break or to accelerate to pass the stop line according to the information, their vehicle loads, the speed, the road surface friction and the distance between the vehicle and the stop line. They take full advantage of the passing time, rather than drive illegally through a red light, so as to reduce the start-up loss time. The reduction of the start-up loss time may not affect the traffic safety and the i-j interval time posterior the yellow light i and before the green light j, but may effectively improve the effective green time.

There is already a multi-figure countdown display used for the traffic signal control. However the multi-figure countdown display needs to adjust the operation time of the green light and the red light when performing the real-time adaptive control, thus causing the inaccurate hopped data of the countdown which affects the extension of the multi-figure countdown display. Therefore the multi-figure countdown display tends to be canceled.

In the real-time dynamic control, the unit time does not have to be adjusted, thus the unit time can exist in harmony with the real-time dynamic control. In order to match the technique for reducing the cycle loss time, reduce the threshold of the Wang channelization scheme, achieve the above mentioned various advantages due to the negative cycle loss time and be compatible with the real-time adaptive control, a "specially designed" one-figure countdown display apparatus is mounted according to the present invention, in which the one-figure countdown display apparatus includes a CPU timing apparatus and a display apparatus and there are no digital communications and dedicated lines between the one-figure countdown display apparatus and the signal controller.

Figure 10:
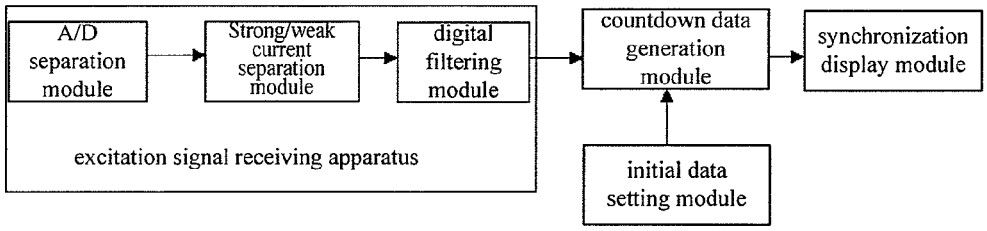
FIG. 10 illustrates a block diagram of the operation of a "specially designed" one-figure countdown display.
Figure 11:
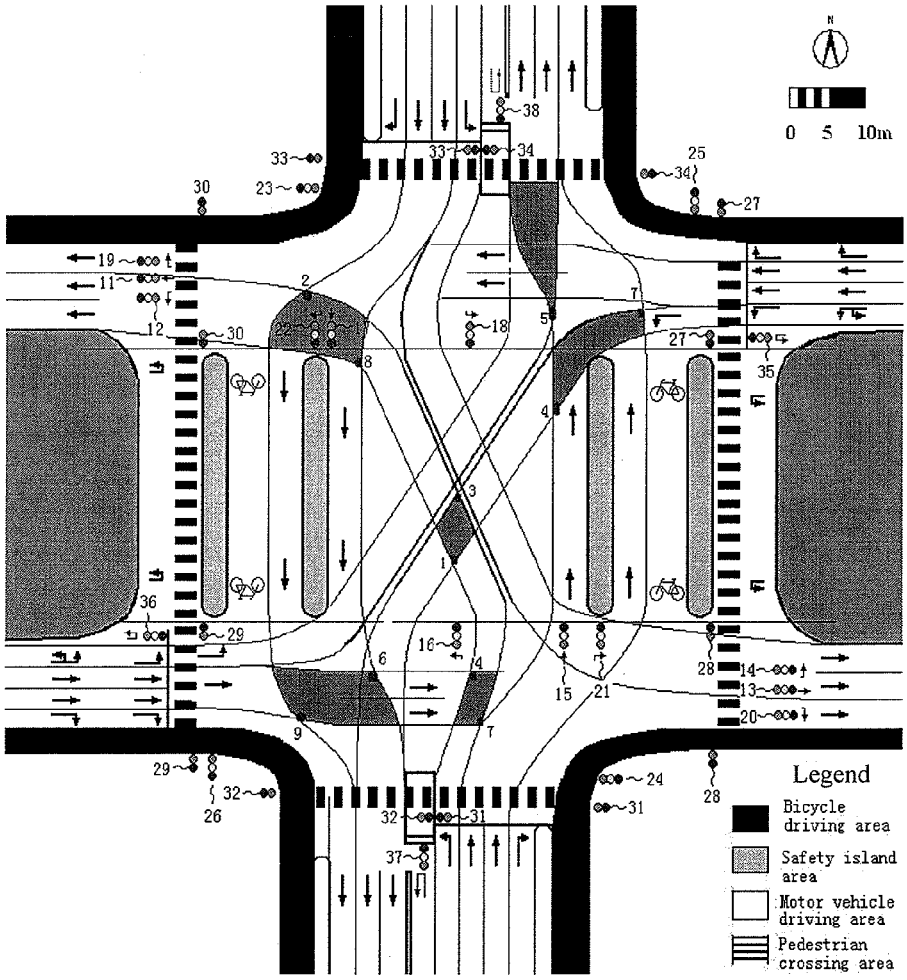
FIG. 11 is a diagram illustrating a Wang channelization scheme for a small intersection and a position of a conflict point in a conflict area.

The countdown display connects to the traffic signal display apparatus. The countdown display extracts the second control signal from signals which are sent by the signal controller and received by the countdown display apparatus, then displays the countdown which starts from a preset number according to the second control signal, and stops the display when the countdown ends. The block diagram of the operation of a "specially designed" one-figure countdown display is as shown in FIG. 10.

The present application provides the above mentioned "specially designed" signal controller, which timely superimposes a second control signal upon a first control signal send to the traffic signal display apparatus, in which the second control signal has a different frequency from the first control signal. Also, the present application provides a traffic signal control system for an intersection, which includes: a signal controller and a traffic signal display apparatus, in which the signal controller is used to execute the control scheme for the intersection determined by the method according to a claim 1, 2, 3, 4, 5, 6 or 7, and to send a command to the traffic signal display apparatus in real time for displaying a traffic signal.

Further, relating to a detection apparatus, the present application provides the above mentioned traffic signal control system, which further includes a detection apparatus for an intersection, in which an information detection apparatus for detecting a clearing vehicle speed is provided at a region near an exit of a crosswalk and takes legal vehicle speeds of the vehicles as the clearing vehicle speed; an information detection apparatus for detecting an entry vehicle speed and acceleration is provided at a region near an entrance of a crosswalk and takes a legal vehicle speed and acceleration of a head vehicle every time released by a green light as the entry vehicle speed and the acceleration; these information detection apparatuses can further detect the traffic flow rates in different flow directions and provide them to the signal controller.

The present application provides the above mentioned traffic signal control system, which performs dynamical design of the control scheme only for the Wang chain family by using the method according to claim 1, 2, 3, 4, 5, 6 or 7, and does not consider any other chain families.

In a seventh embodiment, achieving the dynamical adjusting of the control scheme occurs according to the following process. In this embodiment, the traffic signal control system further includes a detector. The data processing, the networking communication and the model prediction are performed on the detected data, so that the data is both reliable and sensitive and can be converted timely into the traffic flow rate and the traffic speed statistical parameter for the next cycle, so as to participate in the calculation for the real-time design for the minimum green intervals and timing scheme at the next cycle. Thus the dynamical design according to the on-line measured data can be performed.

The steps carried out by the signal controller are substantially similar as those in the fifth embodiment, which are only performed for the Wang chain family and other chain families are abandoned. Of course, there is neither calculation for ratio of the cycle loss time to the cycle in 6) nor comparison and selection in 7). The scheme is improved directly based the scheme frame, put into operation and sent to each of the signal display apparatuses for displaying the signals.

Further, in an eighth embodiment, the coordination signal control system for ground surface road network formed by multi-crossing. The present application provides a coordination signal control system for ground surface road network formed by multi-crossing, which includes the above mentioned traffic signal control system for the crossing, can ensure that the cycle loss time of each of the crossings keeps constant and can allow that each of the crossings doesn't need to have a minimum cycle so as to be able to have the same cycle needed to participate the coordination control.

Although the description of the present application is for the cross intersection, the present application may be applied to other intersections. The traffic signal control system according to the present invention mainly includes: a signal controller, a signal display apparatus, and further includes a detector in the case of the dynamical adjusting scheme, which may be connected wirelessly or via a fiber optic cable or wire. The traffic signal control system further includes the road channelization scheme for determining the minimum green interval and the Wang minimum green time.

The embodiment indicates that additional effective releasing time of 10 seconds is increased for every cycle of 42 seconds, which means that the effective releasing time in one day, i.e. 24 hours, is about 29.714 hours. If a calculation is performed according to the conventional method by "using the minimum limiting value of 4 s as the minimum green interval" and "assigning 3 seconds to the start-up loss time" as described on the 12th pages of the description of the patent ZL200710055390. 2, it is impossible to design a control system with a cycle of 42 seconds. If a four-phase-stage control system with a cycle of 42 seconds and the yellow time of 4 s can be designed by chance, the cycle loss time in a cycle reaches 24 seconds and the effective releasing time in one day is about 10.286 hours. There are 19.428 hours between effective releasing times in one day in the case of the control system with a negative cycle loss time and that in the case of the control system with a positive cycle loss time. The effective releasing time is increased by nearly double of that in the conventional situation.

According to the above mentioned technical solution, the traffic signal control method and system according to the present invention can ensure the traffic safety by accurately setting a relatively lager minimum green interval. The cycle loss time may become negative by four technical means complement each other for reducing the cycle loss time. There are the following advantages if a signal control system has a negative cycle loss time. The total sum of the effective green time of the traffic flow in the key path is larger than the cycle and there is additional effective releasing time. The shorter the cycle loss time, the longer the additional effective releasing time. By using the minimization of the ratio of the cycle loss time to the cycle as an optimization index in the case of the rationally allowed maximum saturation, the absolute value of the negative cycle loss time can reach the maximum, the system cycle can reach the minimum, the proportion of the additional effective releasing time can reach the maximum, the traffic capacity and the traffic efficiency of the intersection can reach the maximum and the delay time due to stop of the vehicle can reach the minimum. Thus the traffic capacity of the frame vehicle flow is increased while the signal cycle is shortened, the stopping and waiting time of the pedestrian and non-motor vehicle is reduced, and the traffic service level is improved, under the premise of ensuring traffic safety and order.

Moreover, the improvement in the operation efficiency of the signal control system for each of the key intersections can definitely lead to the improvement in the overall efficiency of the ground surface road network signal control system, so that traffic congestion of the ground surface road network is greatly alleviated.

In another embodiment, a traffic signal control method for an intersection according to an embodiment of the present invention may include the following steps:

determining an overlapping area between a traffic flow released by a first green light and a traffic flow released by a second green light, according information of an intersection;

determining a first time spent by the traffic flow released by the first green light to pass through the area from the time when the first green light is turned off and a second time spent by the traffic flow released by the second green light to reach the area from the time when the second green is turned on;

determining a third time spent by a vehicle in the traffic flow released by the first green light to finish breaking, according to the information of the intersection;

determining a minimum green interval from the first green light to the second green light by adding difference between the first time and the second time with the third time which is preset reaction time needed for a driver from seeing a signal change to performing break reaction;

determining a control method for the intersection according to the minimum green interval from the first green light to the second green light, and sending a command to a traffic signal display apparatus for displaying a traffic signal, according to the control method.

The above mentioned method may be executed by a traffic signal controller and may also be executed by one or more servers. Moreover, the execution sequence of the above mentioned steps may be adjusted as required. Thus, The above mentioned method may further include: detecting, by at least one detector, a first speed for the traffic flow released by the first green light to pass thought the area at the time when the first green light is turned off and detecting an acceleration or a second speed for the traffic flow released by the second green light to move on to the area at the time when the second green light is turned on, and providing the first speed, the acceleration or the second speed to the signal controller as the information of the intersection.

In the above mentioned method, the determining a control method for the intersection according to the minimum green interval from the first green light to the second green light may specifically include the following steps: assigning at least one non-confliction traffic flows into a group, and arranging each group in a different order, so as to obtain multiple chain families which represent releasing orders of each of the traffic flows, and listing all of the chain families according to different grouping modes; calculating the average value of the cycle loss time $$\overline{L} = \frac{\sum_m \left(\sum_i I_i\right)}{m} - (A - l) \times n$$

for each of the chain families, in which in the chain family, a traffic flow is selected for each group to be a key flow used to form a traffic chain, $I_i$ is the minimum green interval between two adjacent groups of key flows in each of the traffic chains; m is the number of traffic flow chains in the chain family; A is the sum of the third time and the reaction time; l is the preset start-up loss time of the traffic flow; and n is the number of groups in the chain families; and determining the passing orders for each of the traffic flows in the control scheme according to at least one of chain families with the minimum average values of cycle loss time.

The above mentioned method may further include: determining the minimum average value of the cycle loss time for each of at least two road channelization schemes for the intersection respectively, and selecting the road channelization scheme with the minimum value of the minimum average value of the cycle loss time as the road channelization scheme for the intersection, and outputting the information of the selected road channelization scheme.

In the above mentioned method, the determining a control method for the intersection according to the minimum green interval from the first green light to the second green light further includes: calculating the minimum green time for each of the traffic flows, and determining a timing assign scheme for each of the green lights in the control scheme according to the minimum green time, the chain family with the minimum average value of the cycle loss time and the preset design parameters.

In the above mentioned method, the steps for calculating the minimum green time for each of the traffic flows may specifically include: selecting one from the group consisting of 3 seconds, the first green time and the second green time as the minimum green time for a traffic flow, in which the method for determining the first green time including: setting the green time in each of the traffic flows in the chain family as a node, arranging the node according the grouping way for the chain family and the passing sequence, and representing the minimum green interval between two traffic flows belong to the adjacent groups by a directed arrow with a number, so as to form a chain family diagram with a circulating structure; if the sum of the minimum green intervals indicated by parallel straight line arrows is different from the sum of the minimum green intervals indicated by intersecting oblique lines between the two groups of the nodes, increasing one of the minimum green interval, so that the above mentioned two sums of the minimum green intervals are equal; if the total sum of the minimum green intervals prior and posterior the traffic flow is smaller than the minimum green interval between two traffic flows prior and posterior the traffic flow, subtracting the sum of minimum green intervals prior and posterior the traffic flow from the minimum green interval between the prior traffic flow and the posterior traffic flow to obtain the first green time: in which the second green time is as follows: $G=G_{pedestrian}+G_{pedestrian\ flash}+(I_{21}+I_{22})-(I_{11}+I_{12})$, where $G_{pedestrian}$ is the minimum green time of the pedestrian traffic flow in the same direction as the traffic flow; $G_{pedestrian\ flash}$ is a difference between the time needed when passing through the intersection travel distance with a normal walking speed and the time needed when passing through the intersection travel distance with a running speed based on the intersection travel distance for the pedestrian traffic flow, $I_{21}$ is a minimum green interval between the pedestrian traffic flow and a traffic flow prior the traffic flow, $I_{22}$ is a minimum green interval between the pedestrian traffic flow and a traffic flow posterior the traffic flow, In is a minimum green interval between the traffic flow and a traffic flow prior the traffic flow, and $I_{12}$ is a minimum green interval between the traffic flow and a traffic flow posterior the traffic flow.

In the above mentioned method, the determining a timing assign scheme for each of the green lights in the control scheme may specifically include: calculating, for each traffic chain of the chain family, the sum of the minimum green time of each traffic flow and the minimum green interval between traffic flows as the minimum chain length of the traffic chain, and selecting a traffic chain with the maximum value of the minimum chain length from the chain family, and setting the maximum value of the minimum chain length as a first cycle time; assigning the green time for the traffic flows in each of the traffic chains according to the first cycle time, calculating the minimum chain length of each of the traffic chains and setting the maximum value of the minimum chain length as a second cycle time; and selecting the traffic chain corresponding to the second cycle time, if the second cycle time is equal to or smaller than the first cycle time; setting the first cycle time to be equal to the second cycle time and assigning the green time, if the second cycle time is greater than the first cycle time.

In the above mentioned method, the determining a timing assign scheme for each of the green lights in the control scheme may specifically include: assigning the green time for each of the traffic flows in the traffic chain according the split requirement and the first minimum cycle time, and calculating the minimum chain length of each of the traffic chains in the at least one traffic chains according to the result of the assigning, in which the split is the ratio of the effective green time to the cycle time.

In the above mentioned method, the determining a timing assign scheme for each of the green lights in the control scheme may specifically include:

A. setting the green time in each of the traffic flows in the chain family as a node, arranging the node according the grouping way for the chain family and the passing sequence, and representing the minimum green interval between two traffic flows belong to the adjacent groups by a directed arrow with a number, so as to form a chain family diagram with a circulating structure;

if the sum of the minimum green intervals indicated by parallel straight line arrows is different from the sum of the minimum green intervals indicated by intersecting oblique lines between the two groups of the nodes, increasing one of the minimum green interval, so that the above mentioned two sums of the minimum green intervals are equal;

B. determining a split requirement $\lambda_k$ for each of the frame vehicle flows according to the saturation of the traffic flow;

calculating, for each traffic chain of the chain family, the sum of the split requirements of each of the frame vehicle flows in the traffic chain, and setting the maximum value of the sum as the maximum total sum Y of the flow rate ratios, calculating the cycle loss time of the traffic chain with the maximum sum $$L\left(\sum_n I_i\right) - (A - l) \times n,$$

wherein $I_i$ is the minimum green interval between two adjacent groups of key flows in the traffic chain; l is the preset start-up loss time of the traffic flow; and n is the number of the groups in the chain family;

C. calculating, for each traffic chain of the chain family, the sum of the minimum green time $G_{mk}$ of each traffic flow and the minimum green intervals between traffic flows as the minimum chain length of the traffic chain, and selecting a traffic chain with the maximum value of the minimum chain length from the chain family, where the maximum value of the minimum chain length is a first cycle time $C_0$; moving on to D if L<O; and performing the step F if L≥0;

D. performing the step H if $$C_0 > \frac{-L}{Y-1};$$

E. assigning the green time $G_k=\mathrm{Max}\{C_0\times\lambda_k-A+l,G_{mk}\}$ of the traffic flows for the traffic chains; setting $\{G_{mk}\}=\{G_k\}$ and returning back to E if $G_{mk}$ is not equal to $G_k$; otherwise, calculating the minimum chain length of each of the traffic chains according to the obtained green time set $\{G_{mk}\}$, and the maximum value of the minimum chain length as the cycle time $C_1$; setting $C_0=C_1$ and returning back to the step D, if $C_1>C_0$; otherwise setting $C_0=C_1$ and performing the step H;

F. judging whether the first cycle time $C_0$ is smaller than C according to the preset maximum cycle threshold C, and going to the step H if $C_0>C$;

G: assigning the green time $G_k=\mathrm{Max}\{C_0\times\lambda_k-A+l,G_{mk}\}$ for the traffic flows; setting $\{G_{mk}\}=\{G_k\}$ and returning back to the step G, if $G_{mk}$ is not equal to $G_k$; otherwise, calculating the minimum chain length of each of the traffic chains according to the obtained green time set $\{G_{mk}\}$, and setting the maximum value of the minimum chain length as the cycle time $C_1$; setting $C_0=C_1$ and returning back to the step F, if $C_1>C_0$; otherwise setting $C_0=C_1$ and going to the step H;

H: based on the green time set $\{G_{mk}\}$ of the traffic chains corresponding to the cycle time $C_0$, increasing the minimum green time for other traffic flows in each of the groups so as to fulfill the gap of the chain family diagram and determining the chain family scheme, determining the green light on and off time for each of the traffic flows, and using the minimum green time of the traffic flows and the green interval as the control scheme;

I. judging whether the green lights of the conflict traffic flows are allowed to be turned on at the same time according to the preset parameter, and checking if there is the case where the green lights of the conflict traffic flows are turned on at the same time in the case that the green lights of the conflict traffic flows are not allowed to be turned on at the same time, decreasing the green time and assigning the decreased time to the yellow time if there is the case.

In the above mentioned method, a timing assign scheme for each of the green lights in the determined control scheme may specifically further include:

J. setting the green time in each of the traffic flows in the chain family as a node, arranging the node according the grouping way of the chain family and the passing sequence, and representing the minimum green interval between two traffic flows belong to the adjacent groups by a directed arrow with a number, so as to form a chain family diagram with a circulating structure;

K. if the sum of the minimum green intervals indicated by parallel straight line arrows is different from the sum of the minimum green intervals indicated by intersecting oblique lines between the two groups of the nodes in the chain family diagram, recoding two minimum green intervals with the smaller sum as an initial time;

L. increasing a first minimum green interval of the two minimum green intervals with the smaller sum by a preset value, and adjusting a second minimum green interval, so that the sums of the above mentioned two green intervals are equal;

calculating, for each traffic chain of the chain family, the sum of the minimum green time $G_{mk}$ of each traffic flow and the minimum green intervals between traffic flows as the minimum chain length of the traffic chain, and selecting a traffic chain with the maximum value of the minimum chain length from the chain family, and the maximum value of the minimum chain length is set as a first cycle time $C_0$;

judging whether the second minimum green interval is equal to or smaller than the initial time corresponding to the second minimum green interval or not, and going to the step M if the second minimum green interval is equal to or smaller than the initial time, or otherwise going to the step L;

M. obtaining the minimum value of the minimum green interval which occurs many times in the key traffic chain, and adjusting other minimum green intervals, so that the sum of the minimum green intervals indicated by parallel straight line arrows is equal to the sum of the minimum green intervals indicated by intersecting oblique lines between the two groups of the nodes, and adjusting the minimum green time set $\{G_{mk}\}$, so that the total sum of the minimum green intervals prior and posterior each of the traffic flows is smaller than the minimum green interval between two traffic flows prior and posterior the traffic flow;

N. determining split requirement $\lambda_k$ for each of the frame vehicle flows k according to the saturation requirement of the traffic flow;

O. assigning green time $C_k=\text{Max}\{C_0\times\lambda_k-A+l,G_{mk}\}$ for the traffic flows k for the traffic chains; setting $\{G_{mk}\}=\{G_k\}$ and returning back to the step O, if $G_{mk}$ is not equal to $G_k$; otherwise, calculating the minimum chain length of the traffic chain according to the obtained green time set $\{G_{mk}\}$, and setting the maximum value of the minimum chain length as the cycle time $C_1$; setting $C_0=C_1$ and returning back to the step O, if $C_1>C_0$; otherwise setting $C_0=C_1$ and going to the step P;

P. based on the green time set $\{G_{mk}\}$ of the traffic chains corresponding to the cycle time $C_0$, increasing the minimum green time for other traffic flows in the group so as to fulfill the gap of the chain family diagram and determining the chain family scheme, determining the green light on and off time for each of the traffic flow, and using the minimum green time for the traffic flow and the green intervals as the control scheme;

I. judging whether the green light of the conflict traffic flow is allowed to be turned on at the same time, and when the conflict traffic flow green light is not allowed to be turned on at the same time, checking whether there is the case where the green light of the conflict traffic flow is turned on at the same time, decreasing the green time and assigning the decreased time to the yellow time if there is the case.

In the above mentioned method, the road channelization scheme used for the intersection includes an annular road and a road intersecting the annular road, the annular road is used for straight going vehicles and non-motor vehicles, and the center area inside the annular road is the straight going vehicles forbidden area; and the road intersecting the annular road and the center area is used for left-turn vehicles and forms a grade intersection with the annular road for the straight going motor vehicles.

The above mentioned method may further include: providing a countdown display, in which the countdown display connects to the traffic signal display apparatus; the signal controller superimposes a second control signal upon a first control signal send to the traffic signal display apparatus, where the second control signal has a different frequency from the first control signal; the countdown display extracts the second control signal from signals sent by the signal controller and received by the countdown display apparatus, then displays the countdown which starts from a preset number according to the second control signal, and stops the display when then countdown ends. The preset number may be arbitrary number, such as a number equal to or smaller than 9.

An embodiment of the present invention provides a traffic signal control system for an intersection, including: a control scheme determination apparatus, a signal controller and a traffic signal display apparatus. The control scheme determination apparatus may be a single device or multiple devices, and may also be a unit module in the signal controller.

The control scheme determination apparatus is configured to:

determine an overlapping area between a traffic flow released by a first green light and a traffic flow released by a second green light, according information of an intersection;

determine a first time spent by the traffic flow released by the first green light to pass through the area from the time when the first green light is turned off and a second time spent by the traffic flow released by the second green light to reach the area from the time when the second green is turned on;

determine a third time spent by a vehicle in the traffic flow released by the first green light to finish breaking, according to the information of the intersection; and determining a minimum green interval from the first green light to the second green light by adding difference between the first time and the second time with the third time which is preset reaction time needed for a driver from seeing a signal change to performing break reaction;

determine a control method for the intersection according to the minimum green interval from the first green light to the second green light, and providing the control scheme for the signal controller.

A signal controller is configured to sending an instruction to the traffic signal display apparatus according to the control scheme to display the traffic signal. According to an embodiment of the present invention, the above mentioned system may further include:

at least on detector configured to detect a first speed for the traffic flow released by the first green light to pass thought the area at the time when the first green light is turned off and an acceleration or a second speed for the traffic flow released by the second green light to move on to the area at the time when the second green light is turned on, and provide the first speed, the acceleration or the second speed to the signal controller as the information of the intersection.

According to an embodiment of the present invention, the control scheme determination apparatus may further be configured to:

assign at least one non-confliction traffic flows into a group, and arranging each group in a different order, so as to obtain multiple chain families which represent releasing orders of each of the traffic flows, and listing all of the chain families according to the grouping modes;

calculate average value of cycle loss time for each of the chain families $$\overline{L}=\frac{\sum_m\left(\sum_i I_i\right)}{m}-(A-l)\times n,$$

where in each of the chain families, a traffic flow is selected from each group as a key flow to form a traffic chain, $I_i$ is the minimum green interval between two adjacent groups of key flow in the traffic chain; m is the number of different traffic flow chains in the chain family; A is the sum of the third time and the reaction time; l is the preset start-up loss time of the traffic flow; and n is the number of the groups in the chain family; and determine the passing orders for each of the traffic flows in the control scheme according to at least one of chain families with the minimum average values of cycle loss time.

According to an embodiment of the present invention, the above mentioned system may further include a channelization scheme selection apparatus configured to:

determine the minimum average value of the cycle loss time respectively for at least two road channelization schemes for the intersection, and selecting the road channelization scheme with the minimum value of the minimum average value of the system loss as the road channelization scheme for the intersection, and outputting the information of the selected road channelization scheme.

According to an embodiment of the present invention, the control scheme determination apparatus may be configured to: calculate the minimum green time for each of the traffic flows, and determine a timing assign scheme for each of the green lights in the control scheme according to the minimum green time, the chain family with the minimum average value of the system loss and the preset design parameters.

According to an embodiment of the present invention, the control scheme determination apparatus may be configured to: select one from the group consisting of 3 seconds, the first green time and the second green time as the minimum green time for a traffic flow, Further, the method for determining the first green time including:

setting the green time in each of the traffic flows in the chain family as a node, arranging the node according the grouping way for the chain family and the passing sequence, and representing the minimum green interval between two traffic flows belong to the adjacent groups by a directed arrow with a number, so as to form a chain family diagram with a circulating structure;

if the sum of the minimum green intervals indicated by parallel straight line arrows is different from the sum of the minimum green intervals indicated by intersecting oblique lines between the two groups of the nodes, increasing one of the minimum green interval, so that the above mentioned two sums of the minimum green intervals are equal;

if the total sum of the minimum green intervals prior and posterior the traffic flow is smaller than the minimum green interval between two traffic flows prior and posterior the traffic flow, the first green time is calculated by subtracting the sum of the minimum green intervals prior and posterior the traffic flow from a minimum green interval between the prior traffic flow and the posterior traffic flow:

where the second green time is as follows: $G=G_{pedestrian}+G_{pedestrian\ flash}+(I_{21}+I_{22})-(I_{11}+I_{12})$, and where $G_{pedestrian}$ the minimum green time of pedestrian traffic flow in the same direction as the traffic flow; $G_{pedestrian\ flash}$ is a difference between the time needed when passing through the intersection travel distance with a normal walking speed and the time needed when passing through the intersection travel distance with a running speed, which is determined based on the intersection travel distance for the pedestrian traffic flow, $I_{21}$ is a minimum green interval between the pedestrian traffic flow and a traffic flow prior the traffic flow, $I_{22}$ is a minimum green interval between the pedestrian traffic flow and a traffic flow posterior the traffic flow, $I_{11}$ is a minimum green interval between the traffic flow and a traffic flow prior the traffic flow, and $I_{12}$ is a minimum green interval between the traffic flow and a traffic flow posterior the traffic flow.

According to an embodiment of the present invention, the control scheme determination apparatus may be configured to:

calculate, for each traffic chain of the chain family, the sum of the minimum green time of each traffic flow and the minimum green intervals between traffic flows as the minimum chain length of the traffic chain, and select a traffic chain with the maximum value of the minimum chain length from the chain family, where the maximum value of the minimum chain length is a first cycle time;

assign the green time for each of the traffic flows in the traffic chains according to the first cycle time, calculate the minimum chain length of each of the traffic chains and setting the maximum value of the minimum chain length as a second cycle time; and select the traffic chain corresponding to the second cycle time, if the second cycle time is equal to or smaller than the first cycle time; set the first cycle time to be equal to the second cycle time, and assigning the green time, if the second cycle time is greater than the first cycle time.

According to an embodiment of the present invention, the control scheme determination apparatus may be configured to: assign the green time for each of the traffic flows in the traffic chain according to the split of the traffic flow and the minimum first cycle time, and calculate the minimum chain length of each of the traffic chains in the at least one traffic chains according to the result of the assigning, where the split is the ratio of the effective green time to the cycle time.

According to an embodiment of the present invention, the control scheme determination apparatus may be configured to:

A. setting the green time in each of the traffic flows in the chain family as a node, arrange the node according the grouping way for the chain family and the passing sequence, and represent the minimum green interval between two traffic flows belong to the adjacent groups by a directed arrow with a number, so as to form a chain family diagram with a circulating structure;

if the sum of the minimum green intervals indicated by parallel straight line arrows is different from the sum of the minimum green intervals indicated by intersecting oblique lines between the two groups of the nodes, increase one of the minimum green interval, so that the above mentioned two sums of the minimum green intervals are equal;

B. determine split requirement $\lambda_k$ for each of the vehicle flows according to the saturation requirement of the traffic flow;

calculate, for each traffic chain of the chain family, the sum of the split requirements of the vehicle flows in the traffic chain, and set the maximum sum as the maximum total sum Y of the flow rate ratios, calculate the cycle loss time of the traffic chain with the maximum sum $$L\left(\sum_n I_i\right)-(A-l)\times n,$$

where $I_i$ is the minimum green interval between two adjacent groups of key flows in the traffic chain; l is the preset start-up loss time of the traffic flow; and n is the number of the groups in the chain family;

C. calculate, for each traffic chain of the chain family, the sum of the minimum green time $G_{mk}$ of each traffic flow and the minimum green intervals between traffic flows as the minimum chain length of the traffic chain, and select a traffic chain with the maximum value of the minimum chain length from the chain family, where the maximum value of the minimum chain length is a first cycle time $C_0$; go to the step D if $L<0$; and go to the step F if $L\geq 0$;

D. go to the step H if $$C_0>\frac{-L}{Y-1};$$

E. assign green time $G_k=\mathrm{Max}\{C_0\times\lambda_k-A+l,G_{mk}\}$ for the traffic flows k for the traffic chains; set $\{G_{mk}\}=\{G_k\}$ and return back to the step E, if $G_{mk}$ is not equal to $G_k$; otherwise, calculate the minimum chain length of each of the traffic chains according to the obtained green time set $\{G_{mk}\}$, and set the maximum value of the minimum chain length as the cycle time $C_1$; set $C_0=C_1$ and return back to the step D, if $C_1>C_0$; otherwise set $C_0=C_1$ and go to the step H;

F. judge whether the first cycle time $C_0$ is smaller than C according to the preset maximum cycle threshold C, and go to the step H if $C_0>C$;

G: assign green time $G_k=\mathrm{Max}\{C_0\times\lambda_k-A+l,G\}$ for the traffic flows k for the traffic chains respectively; set $\{G_{mk}\}=\{G_k\}$ and return back to the step G, if $G_{mk}$ is not equal to $G_k$;

otherwise, calculate the minimum chain length of each of the traffic chains according to the obtained green time set $\{G_{mk}\}$, and set the maximum value of the minimum chain length as the cycle time $C_1$; set $C_0=C_1$ and returning back to the step F, if $C_1>C_0$; otherwise select $C_0=C_1$ and go to the step H;

H: based on the green time set $\{G_{mk}\}$ of the traffic chains corresponding to the cycle time $C_0$, increase the minimum green time for other traffic flows in the group so as to fulfill the gap of the chain family diagram and determine the chain family scheme, determine the green light on and off times for each of the traffic flows, and use the green time of the traffic flow and the green intervals as the control scheme;

I. judge whether the green light of the conflict traffic flow is allowed to be turned on at the same time according the preset parameter, and when the green light of the conflict traffic flow is not allowed to be turned on at the same time, check if there is the case where the green light of the conflict traffic flow is turned on at the same time, decrease the green time and assign the decreased time to the yellow time if there is the case.

According to an embodiment of the present invention, the control scheme determination apparatus may be configured to:

J. set the green time in each of the traffic flows in the chain family as a node, arrange the node according the grouping way of the chain family and the passing sequence, and represent the minimum green interval between two traffic flows belong to the adjacent groups by a directed arrow with a number, so as to form a chain family diagram with a circulating structure;

K. record two minimum green intervals with the smaller sums as initial time, if the sum of the minimum green intervals indicated by parallel straight line arrows is different from the sum of the minimum green intervals indicated by intersecting oblique lines between the two groups of the nodes in the chain family diagram;

L. increase a first minimum green interval of the two minimum green intervals with the smaller value by a preset value, and adjust a second minimum green interval, so that the sums of the above mentioned two green intervals are equal;

calculate, for each traffic chain of the chain family, the sum of the minimum green time $G_{mk}$ of each traffic flow and the minimum green intervals between traffic flows as the minimum chain length of the traffic chain, and select a traffic chain with the maximum value of the minimum chain length from the chain family, where the maximum value of the minimum chain length is set as a first cycle time $C_0$;

judge whether the second minimum green interval is equal to or smaller than an initial time corresponding to the second minimum green interval or not, and go to the step M if so, otherwise go to the step L;

M. obtaining the minimum value of the minimum green interval which occurs many times in the key traffic chain, and adjust other minimum green intervals, so that the sum of the minimum green intervals indicated by parallel straight line arrows is equal to the sum of the minimum green intervals indicated by intersecting oblique lines between the two groups of the nodes, and adjust the minimum green time set $\{G_{mk}\}$, so that the total sum of the minimum green intervals prior and posterior each of the traffic flows is smaller than the minimum green interval between two traffic flows prior and posterior the traffic flow;

N. determine split requirement $\lambda_k$ for each of the frame vehicle flows k according to the saturation requirement of the traffic flow;

O. assign green time $C_k=\mathrm{Max}\{C_0\times\lambda_k-A+1,G_{mk}\}$ for the traffic flows k for the traffic chains; set $\{G_{mk}\}=\{G_k\}$ and return back to the step O, if $G_{mk}$ is not equal to $G_k$; otherwise, calculate the minimum chain length of the traffic chains according to the obtained green time set $\{G_{mk}\}$, and set the maximum value of the minimum chain length as the cycle time $C_1$; set $C_0=C_1$ and return back to the step O, if $C_1>C_0$; otherwise set $C_0=C_1$ and go to the step P;

P. based on the green time set $\{G_{mk}\}$ of the traffic chains corresponding to the cycle time $C_0$, increase the minimum green time for other traffic flows in the group so as to fulfill the gap of the chain family diagram and determine the chain family scheme, determine the green light on and off times for each of the traffic flows, and use the minimum green time for the traffic flow and the green interval as the control scheme;

I. judge whether the green light of the conflict traffic flow is allowed to be turned on at the same time, and when the conflict traffic flow green light is not allowed to be turned on at the same time, check if there is the case where the green light of the conflict traffic flow is turned on at the same time, decrease the green time and assigning the decreased time to the yellow time if there is the case.

According to an embodiment of the present invention, the above mentioned system may include at least one countdown display connected to the traffic signal display apparatus. The countdown display is configured to: receive a second control signal which is superposed upon a first control signal send to the traffic signal display apparatus by the signal controller, where the second control signal has a different frequency from the first control signal; extract the second control signal; and display the countdown which starts from a preset number according to the second control signal and stop the display when then countdown ends. The preset number may be arbitrary number, such as a number equal to or smaller than 9.

In summary, this application provides a strong robustious and high efficient signal control system at a key intersection, the design method and the special device according to preferred indexes, such as the system, the road channelization and the phase structure, and design optimization techniques. Thus the present application has completely new technology performance and there is no precedent in the history. The present application creates a new aspect for the development of control technology and belongs to a pioneering invention. The present application have completely changed the traditional concepts that "the more the phase stages are, the greater the cycle loss time is", "it is best to concentrate the motor vehicle conflict points in the center of an intersection as much as possible in the cross channelization", "the longer the cycle is, the greater the traffic capacity is" and so on.

What is claimed is:

1. A traffic signal control method comprising determining a minimum green interval, wherein the traffic signal control method comprises:

determining positions of a critical point for a traffic flow according to an engineering design for a road channelization of an intersection;

determining a maximum clearing distance $s_i(m)$ of a traffic tail unit released by a green light i and a minimum entry distance $s_j(m)$ of a traffic head unit released by a green light j in conflict with the green light i;

calculating a maximum clearing time $\mathrm{Max}\{t_i\}$ of the traffic tail unit released by the green light i and a minimum entry time $\mathrm{Min}\{t_j\}$ of the traffic head unit released by the green light j;

calculating a minimum green interval $I_{ij}=A+\mathrm{Max}\{t_i\}-\mathrm{Min}\{t_j\}$, wherein A is the yellow time; and determining a control scheme for the intersection according to the minimum green interval and controlling an operation of a signal light according to the control scheme.

2. The traffic signal control method according to claim 1, wherein the determining a control scheme for an intersection according to the minimum green interval further comprises:

sequentially connecting green times and green intervals of a frame vehicle flow which is possible to be a cycle path, so as to from a vehicle flow chain; classifying vehicle flow chains with the same basic phase stage and sequence into a chain family, regardless of the start and end of the vehicle flow; calculating the minimum green interval $I_i$ for the traffic flow; calculating average value of cycle loss time for each of the vehicle flow chain in the same chain family except for a cross stage vehicle flow chain: $L=\Sigma(\Sigma I_i)/m-(A-l)\times n$, wherein m is the number of the traffic flow chains in the chain family; l is a start-up loss time; n is the number of the green intervals in the traffic flow chain; a chain family with the minimum L is defined as a Wang chain family, and a chain family with the sub-minimum L is defined as a sub-Wang chain family;

adopting a basic phase structure and a sequence structure of at least one of chain families with the minimum average value of the cycle loss time;

achieving that the green time is equal to or greater than Wang minimum green time $\{G_{mi}\}$ and the green interval is equal to or greater than the minimum green interval; drawing a chain family diagram and determining an adjustable green interval, an adjustable green time and the minimum compatible scheme $\{I_i\}$; calculating the total sum of the flow rate ratio of each of traffic flow chains in the chain family according to the number $\{n_i\}$ of traffic lanes of each of traffic flows, the saturated flow rate $\{Q_{si}\}$ of the traffic lane, a flow rate requirement $\{Q_i\}$ of the traffic flows and the maximum saturation requirement q, and calculating the total sum of split requirements $\lambda_i$ in the chain family and denoting the maximum total sum by Y; denoting, by L', the cycle loss time of a path with the maximum total sum of the split requirements $\lambda_i$ in the chain family;

if not all of L' of the chain families are not larger than 0 at the same time, determining a green light timing scheme and a key path only for chain families with L'<0, and calculating the cycle loss time for the obtained schemes, so as to select a scheme with a relatively smaller ratio of the cycle loss time to the cycle and running the selected scheme; otherwise moving on; and determining the green light timing scheme and the key path for each of the chain families, and calculating the cycle loss time for the obtained schemes, so as to select a scheme with a relatively smaller ratio of the cycle loss time and running the selected scheme.

3. The traffic signal control method according to claim 2, wherein the determining the minimum compatible scheme $\{I_i\}$ further comprises:

a) setting the green time of the traffic flow in the chain family as a node, arranging the node according the grouping way and the passing sequence of the chain family, and representing the minimum green interval between two traffic flows belong to the adjacent groups by a directed arrow with a number, so as to form a chain family diagram with a circulating structure;

b) if the sum of the minimum green intervals indicated by parallel straight line arrows between the two groups of the nodes is different from the sum of the minimum green intervals indicated by intersecting oblique lines, setting two minimum green intervals with the smaller sums as initial time;

c) calculating, for each traffic chain of the chain family, the sum of the Wang minimum green time $G_{mk}$ of each traffic flow and the green intervals between traffic flows as the minimum chain length of the traffic chain, and selecting a traffic chain with the maximum value of the minimum chain length from the chain family as a key traffic chain, wherein the maximum value of the minimum chain length is set as a first cycle time $C_0$;

d) recording one of the two minimum green intervals with the smaller sums which appears many times in the key traffic chain as a first green interval, adding a predetermined value to a second green interval and adjusting the first green interval, so that the sum of the minimum green intervals indicated by parallel straight line arrows between the two groups of the nodes is equal to the sum of the minimum green intervals indicated by intersecting oblique lines;

e) judging whether the first green interval is equal to or smaller than the initial time corresponding to the first green interval, wherein when the first green interval is larger than the initial time corresponding to the first green interval performing the step c);

f) setting the first green interval as the minimum green interval, adjusting other green intervals so that the sum of the minimum green intervals indicated by parallel straight line arrows is equal to the sum of the minimum green intervals indicated by intersecting oblique lines, adjusting a minimum green time set $\{G_{mk}\}$ so that the total sum of the minimum green time set and the minimum green intervals prior and posterior the traffic flow is not smaller than the minimum green interval between two traffic flows prior and posterior the traffic flow;

g) using the green intervals of the obtained compatible scheme for the design of the control scheme.

4. The traffic signal control method according to claim 2, comprising determining Wang minimum green time further comprises: selecting a maximum one from the group consisting of 3 seconds, a first green time and a second green time as the minimum green time for a traffic flow;

wherein the method for determining the first green time comprises:

obtaining the first green time by subtracting the sum of compatible green intervals prior and posterior the traffic flow from a minimum green interval between a prior traffic flow and a posterior traffic flow in the traffic flow chain; and wherein the second green time is as follows: $G=G_{pedestrian}+G_{pedestrian\ flash}+(I_{21}+I_{22})-(I_{11}+I_{12})$, wherein $G_{pedestrian}$ is the minimum green time of a pedestrian traffic flow in the same direction as the traffic flow; $G_{pedestrian\ flash}$ is a difference between the time needed when general people passing through the clearing distance with a normal walking speed and the time needed when fast people passing through the clearing distance with a speed faster than a certain threshold, which is determined based on the clearing distance for the pedestrian traffic flow; $I_{21}$ is a minimum green interval between the pedestrian traffic flow and a traffic flow prior the pedestrian, $I_{22}$ is a minimum green interval between the pedestrian traffic flow and a traffic flow posterior the pedestrian, $I_{11}$ is a minimum green interval between the traffic flow and a traffic flow prior the traffic flow, and $I_{12}$ is a minimum green interval between the traffic flow and a traffic flow posterior the traffic flow.

5. The traffic signal control method according to claim 2, wherein the determining a green light timing scheme and a key path for chain families, and calculating the cycle loss time for the obtained schemes further comprises:

performing the scheme design in the selected chain family, wherein the scheme design comprises:

a) determining, with equal saturation, split requirement $\{\lambda_i\}$ for the frame vehicle flow, wherein $\lambda_i=Q_i/qn_iQ_{si}$; if $L'\geq 0$, giving the maximum allowed cycle C, calculating the total sum of split requirements $\lambda_i$ for the traffic chain in the chain family and denoting the maximum total sum by Y;

b) starting with the Wang minimum green time set $\{G_{mi}\}$ and the minimum compatible scheme $\{I_i\}$ and going to the next step;

c) calculating the minimum chain length for each of the traffic flow chains in the chain family, and setting the maximum value of the minimum chain length as a minimum cycle time $C_0$ to be selected;

d) setting $\{G_i\}=\{G_{mi}\}$ and wherein if $Y>1-(L'/C_0)$ which means an over saturation going to step h), otherwise going to the next step;

e) assigning a integer green time $\{G_i\}$ for the frame vehicle flow according to the following equation which uses $C_0$:

$$G_j=\mathrm{Max}\{C_0\lambda_i-A+l,G_{mj}\}$$

wherein $\lambda_i$ is the split requirement of the frame vehicle flow j; is the green time of the frame vehicle flow; A is the yellow time; l is the start-up loss time; $C_0$ is the cycle; and $G_{mj}$ is the minimum green time;

wherein if the $\{G_i\}$ is equal to a previous $\{G_i\}$ or $\{G_{mi}\}$ going to step h); otherwise setting $\{G_i\}=\{G_{mi}\}$ and going to the next step;

f) substituting the green time set $\{G_i\}$ into the equation for calculating the minimum chain length for each of the traffic flow chains, and setting the maximum value of the minimum chain length as a minimum cycle time $C_1$, adjust the minimum compatible scheme if the minimum compatible scheme has an adjustment capability to make other adjustable green intervals be minimum compatible with the minimum compatible scheme; and adjust corresponding green time set and calculate the cycle time $C_i$;

g) going to the next step if the cycle time $C_1\leq C_0$; otherwise setting $C_0=C_1$; and then going to the next step, if $C_0$ exceeds an expected maximum cycle, i.e. $C_0>-L'/Y-1)$ when $L'<0$ and $Y>1$, or $C_0$ exceeds a given maximum allowable cycle C when $L'\geq 0$, which means the critical saturation; otherwise returning to the step e);

h) setting the integer green time set $\{G_i\}$ and the minimum compatible schemes $\{I_i\}$ for the key frame vehicle flows with the maximum value of the minimum chain lengths in the group as the minimum frame, increasing the integer green time for other frame vehicle flows so as to fulfill the gap of the chain family diagram and determining the chain family scheme and determining the green light on and off time frames for each of the frame vehicle flows;

i) determining the derivative phase stage farmed because the green light turns on early or turns off late or overlaps and determining the phase stage time and phase interval, by comparing the green time $\{G_i\}$ and the green interval $\{I_i\}$ corresponding to the chain family scheme;

j) setting the minimum green interval as a constraint, determining the early-on time and late-off time of traffic flow green lights for the pedestrians, the non-motor vehicles and the right-turn vehicles, and configuring the green time, wherein a traffic flow with a larger flow rate is given a relatively longer green time under the premise of the guarantee that the traffic flow green lights of pedestrians, non-motor vehicles and right-turn vehicles all exist; and k) drawing a signal light group-phase stage diagram, verifying and putting each timing data into operation; sending the timing data to the display apparatus for displaying.

6. The traffic signal control method according to claim 1, wherein screening the road channelization schemes for the intersection further comprises:

determining the average value of the cycle loss time of the Wang chain family for each of at least two road channelization schemes for the intersection, and selecting the road channelization scheme with the minimum value of the average value of the cycle loss time of the Wang chain family as the road channelization scheme of the intersection, and outputting the information of the selected road channelization scheme.

7. The traffic signal control method according to claim 1, further comprising using a countdown display to synchronously continuously decreasingly display the remaining time determined by a corresponding signal of a light signal in second during at least the last 5 or 6 seconds.

8. A traffic signal control system for an intersection, comprising a signal controller and a traffic signal display apparatus, wherein the signal controller is used to execute a control scheme for the intersection, wherein the control scheme comprises:

determining positions of a critical point for a traffic flow according to an engineering design for a road channelization of an intersection;

determining a maximum clearing distance $s_i(m)$ of a traffic tail unit released by a green light i and a minimum entry distance $s_j(m)$ of a traffic head unit released by a green light j in conflict with the green light i;

calculating a maximum clearing time $\mathrm{Max}\{t_j\}$ of the traffic tail unit released by the green light i and a minimum entry time $\mathrm{Min}\{t_j\}$ of the traffic head unit released by the green light j;

calculating a minimum green interval $I_{ij}=A+\mathrm{Max}\{t_i\}-\mathrm{Min}\{t_j\}$, wherein A is the yellow time; and determining a control scheme for an intersection according to the minimum green interval and controlling an operation of a signal light according to the control scheme.

9. The traffic signal control system according to claim 8, further comprising:

at least one information detection apparatus, wherein an information detection apparatus for detecting a clearing vehicle speed is provided at a region near an exit of a crosswalk and takes all of legal vehicle speeds of the vehicles as the clearing vehicle speeds; an information detection apparatus for detecting an entry vehicle speed and acceleration is provided at a region near an entrance of a crosswalk and takes a legal vehicle speed and acceleration of a head vehicle every time released by a green light as the entry vehicle speed and the acceleration; these information detection apparatuses can further detect the traffic flow rates in different flow directions and provide the detected traffic flow rates to the signal controller.

10. The traffic signal control system according to claim 8, wherein the display apparatus further comprises a countdown display.

11. The traffic signal control system according to claim 10, wherein the countdown display comprises an excitation signal receiving apparatus, an initial data setting module, a countdown data generation module, and a synchronous display module, and further comprises a CPU timing apparatus and a display apparatus and there are no digital communications and dedicated digital communication lines between the one-figure countdown display and the signal controller:

the countdown display connects to the traffic signal display apparatus; and the countdown display extracts the second control signal from signals which are sent by the signal controller and received by the countdown display, displays the countdown which starts from a preset number according to the second control signal, and stops displaying when then countdown ends.

12. The traffic signal control system according to claim 10, wherein the signal controller timely superimposes a second control signal on a first control signal send to the traffic signal display apparatus, wherein the second control signal has a different frequency from the first control signal.

13. The traffic signal control system according to claim 8, wherein the road channelization scheme used for the intersection comprises an annular road and a road intersecting the annular road, wherein the annular road is used for straight going vehicles and non-motor vehicles to run, and the center area inside the annular road is a straight going vehicles forbidden area; the road intersecting the annular road and the center area is used for left-turn vehicles to run and forms a grade intersection with the annular road for the straight going motor vehicles.

14. The traffic signal control system according to claim 8, wherein dynamical design of the control scheme is performed only for the Wang chain family, without considering any other chain families.

* * * * *

UNITED STATES PATENT AND TRADEMARK OFFICE

CERTIFICATE OF CORRECTION

PATENT NO. : 8,717,195 B2
APPLICATION NO. : 13/575893
DATED : May 6, 2014
INVENTOR(S) : Wang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 19 days.

Signed and Sealed this
Twenty-ninth Day of September, 2015

Michelle K. Lee

Michelle K. Lee
*Director of the United States Patent and Trademark Office*